US009874092B2

(12) United States Patent
Lee et al.

(10) Patent No.: US 9,874,092 B2
(45) Date of Patent: Jan. 23, 2018

(54) FLUID PRESSURE PULSE GENERATOR FOR A DOWNHOLE TELEMETRY TOOL

(71) Applicant: EVOLUTION ENGINEERING INC., Calgary (CA)

(72) Inventors: Gavin Gaw-Wae Lee, Calgary (CA); Justin C. Logan, Calgary (CA); Aaron W. Logan, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 15/320,206

(22) PCT Filed: Jun. 22, 2015

(86) PCT No.: PCT/CA2015/050576
§ 371 (c)(1),
(2) Date: Dec. 19, 2016

(87) PCT Pub. No.: WO2015/196282
PCT Pub. Date: Dec. 30, 2015

(65) Prior Publication Data

US 2017/0138186 A1 May 18, 2017

Related U.S. Application Data

(60) Provisional application No. 62/016,869, filed on Jun. 25, 2014.

(51) Int. Cl.
*E21B 47/18* (2012.01)

(52) U.S. Cl.
CPC ..... *E21B 47/18* (2013.01)

(58) Field of Classification Search
CPC ..... E21B 47/187; E21B 34/08; E21B 47/18; G01V 1/52

(Continued)

(56) References Cited

U.S. PATENT DOCUMENTS 3,739,331 A 6/1973 Godbey et al.
4,914,637 A 4/1990 Goodsman (Continued)

FOREIGN PATENT DOCUMENTS

CA 1228909 11/1987
CA 1268052 4/1990

(Continued)

OTHER PUBLICATIONS

International Search Report and Written Opinion dated Sep. 18, 2015, in PCT/CA2015/050587, filed Jun. 25, 2015.

(Continued)

*Primary Examiner* — Albert Wong
(74) *Attorney, Agent, or Firm* — Hovey Williams LLP

(57) ABSTRACT

A fluid pressure pulse generator for a downhole telemetry tool comprising a stator and a rotor. The stator comprises a stator body and a plurality of radially extending stator projections spaced around the stator body, whereby adjacently spaced stator projections define stator flow channels extending therebetween. The rotor comprises a rotor body and a plurality of radially extending rotor projections spaced around the rotor body. The rotor projections are axially adjacent to the stator projections and the rotor is rotatable relative to the stator such that the rotor projections move in and out of fluid communication with the stator flow channels to create fluid pressure pulses in fluid flowing through the stator flow channels. The rotor projections may be positioned downhole of the stator projections and include a self-correction mechanism to move the rotor to an open flow position where the rotor projections are out of fluid communication with the stator flow channels if the telemetry tool fails. The stator body may be configured to fixedly attach to a pulser assembly of the downhole telemetry tool and the rotor may be configured to fixedly attach to a driveshaft of (Continued)

the pulser assembly with the driveshaft and/or the rotor body received within the bore of the stator body such that the stator projections are positioned between the pulser assembly and the rotor projections.

17 Claims, 29 Drawing Sheets

(58) Field of Classification Search
USPC ..... 367/83–84; 175/48
See application file for complete search history.

(56) References Cited

U.S. PATENT DOCUMENTS

| | | | |
|---|---|---|---|
| 5,357,483 | A | 10/1994 | Innes |
| 5,586,083 | A | 12/1996 | Chin et al. |
| 5,636,178 | A | 6/1997 | Ritter |
| 5,740,126 | A | 4/1998 | Chin et al. |
| 7,083,008 | B2 | 8/2006 | Thorp et al. |
| 7,133,325 | B2 | 11/2006 | Kotsonis et al. |
| 7,230,880 | B2 | 6/2007 | Lehr |
| 8,020,632 | B2 | 9/2011 | Moriarty |
| 8,138,943 | B2 | 3/2012 | Kusko et al. |
| 8,151,905 | B2 | 4/2012 | Song |
| 8,181,719 | B2 | 5/2012 | Bunney et al. |
| 2009/0266544 | A1 | 10/2009 | Redlinger et al. |
| 2011/0280105 | A1 | 11/2011 | Hall et al. |
| 2014/0028293 | A1 | 1/2014 | Johnson et al. |

FOREIGN PATENT DOCUMENTS

| | | |
|---|---|---|
| CA | 1299998 | 5/1992 |
| CA | 2174017 | 10/1996 |
| CA | 2098676 | 11/1997 |
| CA | 2528999 | 9/2009 |
| CA | 2506912 | 7/2013 |
| CA | 2855930 | 5/2014 |
| CN | 203271731 | 11/2013 |
| CN | 203452776 | 2/2014 |
| CN | 103410503 | 6/2016 |
| GB | 2271790 | 2/1996 |
| GB | 2443096 | 10/2008 |
| WO | 2014/071514 | 5/2014 |

OTHER PUBLICATIONS

International Search Report and Written Opinion dated Sep. 23, 2015, in PCT/CA2015/050586, filed Jun. 25, 2015.
International Search Report and Written Opinion dated Sep. 22, 2015, in PCT/CA2015/050576, filed Jun. 22, 2015.
International Search Report and Written Opinion dated Jan. 17, 2017, in PCT/CA2016/051298, filed Nov. 8, 2016.

FLUID PRESSURE PULSE GENERATOR FOR A DOWNHOLE TELEMETRY TOOL

RELATED APPLICATIONS

This is a national stage application under 35 U.S.C. §371 of International Patent Application No. PCT/CA2015/050576, filed Jun. 22, 2015, which claims benefit of U.S. Provisional Patent Application No. 62/016,869, filed Jun. 25, 2014, both of which are incorporated by reference in their entireties.

FIELD

This disclosure relates generally to a fluid pressure pulse generator for a downhole telemetry tool, such as a mud pulse telemetry measurement-while-drilling ("MWD") tool.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight drill collars. The BHA is conveyed into the wellbore by a string of metallic tubulars (i.e. drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

One type of downhole MWD telemetry known as mud pulse telemetry involves creating pressure waves ("pulses") in the drill mud circulating through the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulses or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Pulse frequency is typically governed by pulse generator motor speed changes. The pulse generator motor requires electrical connectivity with the other elements of the MWD probe.

One type of valve mechanism used to create mud pulses is a rotor and stator combination where a rotor can be rotated relative to the stator between an opened position where there is no restriction of mud flowing through the valve and no pulse is generated, and a restricted flow position where there is restriction of mud flowing through the valve and a pressure pulse is generated.

SUMMARY

According to a first aspect, there is provided a fluid pressure pulse generator apparatus for a downhole telemetry tool comprising a stator and a rotor. The stator comprises a stator body and a plurality of radially extending stator projections spaced around the stator body, whereby adjacently spaced stator projections define stator flow channels extending therebetween. The rotor comprises a rotor body and a plurality of radially extending rotor projections spaced around the rotor body, the rotor projections having a radial profile with an uphole end, a downhole end and two opposed side faces extending therebetween. The rotor projections are axially adjacent to the stator projections with the rotor projections downhole relative to the stator projections and the rotor is rotatable relative to the stator such that the rotor projections move in and out of fluid communication with the stator flow channels to create fluid pressure pulses in fluid flowing through the stator flow channels. A section of the radial profile of at least one of the rotor projections is tapered towards the uphole end, whereby if rotation is stopped when the tapered section of the at least one rotor projection is in fluid communication with the stator flow channels, the fluid flowing through the stator flow channels impinges on the tapered section and moves the rotor until the tapered section of the at least one rotor projection is out of fluid communication with the stator flow channels.

At least one of the side faces of the tapered rotor projection may have a bevelled uphole edge. Both of the side faces of the tapered rotor projection may have a bevelled uphole edge. The stator projections may have a radial profile with an uphole end, a downhole end and two opposed side faces extending therebetween. The uphole end of at least one of the stator projections may be rounded. A section of the radial profile of at least one of the stator projections may be tapered towards the uphole end.

At least one of the rotor projections may include a bypass channel with an axial channel inlet and an axial channel outlet for flow of the fluid from an uphole side to a downhole side of the at least one rotor projection comprising the bypass channel when the rotor projections are in fluid communication with the stator flow channels. The radial profile of the rotor projections may further comprise an end face extending between the uphole end and the downhole end, and the bypass channel may comprise a groove in the end face. A width of the at least one rotor projection comprising the bypass channel may be greater than a width of the stator flow channels.

At least one of the rotor projections may include a bypass channel with an axial channel inlet and an axial channel outlet for flow of the fluid therethrough when the rotor projections are in fluid communication with the stator flow channels. The rotor projections may be wider than the stator flow channels.

At least one of the rotor projections may taper radially in the downhole direction. The at least one radially tapered rotor projection may be longitudinally extended.

The stator body may have a bore therethrough and at least a portion of the rotor body may be received within the bore. The rotor body may have a bore therethrough and the apparatus may further comprise a rotor cap comprising a cap body and a cap shaft, the cap shaft being received in the bore of the rotor body. A downhole end of the cap body may be rounded.

According to another aspect, there is provided a downhole telemetry tool comprising a pulser assembly and the fluid pressure pulse generator apparatus of the first aspect. The pulser assembly comprises a housing enclosing a motor coupled with a driveshaft. The driveshaft is fixedly attached to the rotor and the motor rotates the driveshaft and rotor relative to the stator.

An uphole end of the stator body may be fixedly attached to a downhole end of the housing and the stator body may have a bore therethrough with the driveshaft and/or the rotor body received within the bore of the stator body such that the stator projections are positioned between the pulser assembly and the rotor projections. At least a portion of the rotor body may be received within the bore in the stator body. The rotor body may have a bore therethrough which receives the driveshaft. The downhole telemetry tool may further comprise a rotor cap comprising a cap body and a cap shaft. The cap shaft may be received in the bore of the rotor body. The rotor cap may releasably attach the rotor to the driveshaft. A downhole end of the cap body may be rounded.

According to another aspect, there is provided a fluid pressure pulse generator apparatus for a downhole telemetry tool, comprising a stator and a rotor. The stator comprises a stator body with a bore therethrough and a plurality of radially extending stator projections spaced around an external surface of the stator body, whereby adjacently spaced stator projections define stator flow channels extending therebetween. The rotor comprises a rotor body and a plurality of radially extending rotor projections spaced around an external surface of the rotor body. An end of the stator body is configured to fixedly attach to a pulser assembly of the downhole telemetry tool and the rotor is configured to fixedly attach to a driveshaft of the pulser assembly with the driveshaft and/or the rotor body received within the bore of the stator body such that the stator projections are positioned between the pulser assembly and the rotor projections. The rotor projections are axially adjacent to the stator projections and the rotor is rotatable relative to the stator such that the rotor projections move in and out of fluid communication with the stator flow channels to create fluid pressure pulses in fluid flowing through the stator flow channels.

The rotor projections may be positioned downhole relative to the stator projections. The rotor projections may have a radial profile with an uphole end, a downhole end and two opposed side faces extending therebetween. A section of the radial profile of at least one of the rotor projections may be tapered towards the uphole end, whereby if rotation is stopped when the tapered section of the at least one rotor projection is in fluid communication with the stator flow channels, the fluid flowing through the stator flow channels impinges on the tapered section and moves the rotor until the tapered section of the at least one rotor projection is out of fluid communication with the stator flow channels. At least one of the side faces of the tapered rotor projection may have a bevelled uphole edge. Both of the side faces of the tapered rotor projection may have a bevelled uphole edge.

The stator projections may have a radial profile with an uphole end, a downhole end and two opposed side faces extending therebetween. The uphole end of at least one of the stator projections may be rounded. A section of the radial profile of at least one of the stator projections may be tapered towards the uphole end.

At least one of the rotor projections may taper radially in the downhole direction. The at least one radially tapered rotor projection may be longitudinally extended.

At least a portion of the rotor body may be received within the bore of the stator body. The rotor body may have a bore therethrough and the apparatus may further comprise a rotor cap comprising a cap body and a cap shaft, the cap shaft being received in the bore of the rotor body. A downhole end of the cap body may be rounded.

At least one of the rotor projections may include a bypass channel with an axial channel inlet and an axial channel outlet for flow of the fluid from an uphole side to a downhole side of the at least one rotor projection comprising the bypass channel when the rotor projections are in fluid communication with the stator flow channels. The radial profile of the rotor projections may further comprise an end face extending between the uphole end and the downhole end, and the bypass channel may comprise a groove in the end face. A width of the at least one rotor projection comprising the bypass channel may be greater than a width of the stator flow channels.

According to another aspect, there is provided a downhole telemetry tool comprising a pulser assembly and a fluid pressure pulse generator apparatus. The pulser assembly comprises a housing enclosing a motor coupled with a driveshaft. The fluid pressure pulse generator apparatus comprises a stator and a rotor. The stator comprises a stator body with a bore therethrough and a plurality of radially extending stator projections spaced around an external surface of the stator body, whereby adjacently spaced stator projections define stator flow channels extending therebetween. The rotor comprises a rotor body and a plurality of radially extending rotor projections spaced around an external surface of the rotor body. An end of the stator body is fixedly attached to the housing and the rotor is fixedly attached to the driveshaft with the driveshaft and/or the rotor body received within the bore of the stator body such that the stator projections are positioned between the pulser assembly and the rotor projections. The rotor projections are axially adjacent to the stator projections and the motor can rotate the driveshaft and rotor relative to the stator such that the rotor projections move in and out of fluid communication with the stator flow channels to create fluid pressure pulses in fluid flowing through the stator flow channels. The stator body may be fixedly attached to a downhole end of the housing and the rotor projections may be positioned downhole relative to the stator projections.

According to another aspect, there is provided a downhole telemetry tool comprising: a pulser assembly comprising a housing enclosing a driveshaft; and a fluid pressure pulse generator apparatus. The fluid pressure pulse generator apparatus comprises: a stator comprising a stator body with a bore therethrough and a plurality of radially extending stator projections spaced around an external surface of the stator body, whereby adjacently spaced stator projections define stator flow channels extending therebetween; and a rotor comprising a rotor body and a plurality of radially extending rotor projections spaced around an external surface of the rotor body. An end of the stator body is fixedly attached to a downhole end of the housing and the rotor is fixedly attached to the driveshaft with the driveshaft and/or the rotor body received within the bore of the stator body such that the stator projections are positioned between the pulser assembly and the rotor projections and the rotor projections are positioned downhole relative to the stator projections. The rotor projections are axially adjacent to the stator projections and rotate relative to the stator projections such that the rotor projections move in and out of fluid communication with the stator flow channels to create fluid pressure pulses in fluid flowing through the stator flow channels.

The rotor projections may have a radial profile with an uphole end, a downhole end and two opposed side faces extending therebetween. A section of the radial profile of at least one of the rotor projections may be tapered towards the uphole end, whereby if rotation is stopped when the tapered section of the at least one rotor projection is in fluid communication with the stator flow channels, the fluid flowing through the stator flow channels impinges on the tapered section and moves the rotor until the tapered section of the at least one rotor projection is out of fluid communication with the stator flow channels. At least one of the side faces of the tapered rotor projection may have a bevelled uphole edge. Both of the side faces of the tapered rotor projection may have a bevelled uphole edge.

The stator projections may have a radial profile with an uphole end, a downhole end and two opposed side faces extending therebetween. The uphole end of at least one of the stator projections may be rounded. A section of the radial profile of at least one of the stator projections may be tapered towards the uphole end.

At least one of the rotor projections may taper radially in the downhole direction. The at least one radially tapered rotor projection may be longitudinally extended.

At least a portion of the rotor body may be received within the bore of the stator body. The rotor body may have a bore therethrough which receives the driveshaft. The downhole telemetry tool may further comprise a rotor cap comprising a cap body and a cap shaft. The cap shaft may be received in the bore of the rotor body to releasably couple the rotor cap to the driveshaft. A downhole end of the cap body may be rounded.

At least one of the rotor projections may include a bypass channel with an axial channel inlet and an axial channel outlet for flow of the fluid from an uphole side to a downhole side of the at least one rotor projection comprising the bypass channel when the rotor projections are in fluid communication with the stator flow channels. The radial profile of the rotor projections may further comprise an end face extending between the uphole end and the downhole end, and the bypass channel may comprise a groove in the end face. A width of the at least one rotor projection comprising the bypass channel may be greater than a width of the stator flow channels.

At least one of the rotor projections may include a bypass channel with an axial channel inlet and an axial channel outlet for flow of the fluid therethrough when the rotor projections are in fluid communication with the stator flow channels. The rotor projections may be wider than the stator flow channels.

At least one of the rotor projections may be angled relative to a flow path of the fluid flowing through the stator flow channels, such that the fluid flowing through the stator flow channels hits the at least one angled rotor projection causes the rotor to rotate relative to the stator. The stator projections may have a radial profile with an uphole end, a downhole end and two opposed side faces extending therebetween. At least one of the side faces may be angled relative to the flow path of the fluid flowing through the stator flow channels.

The downhole telemetry tool may further comprise an angled blade array coupled to the rotor body, the angled blade array comprising one or more than one angled blade positioned downhole of the rotor projections and extending into a flow path of fluid flowing through the fluid pressure pulse generator. The angled blade may be angled relative to the flow path of fluid flowing through the fluid pressure pulse generator such that the fluid flowing through the fluid pressure pulse generator hits the angled blade causing rotation of the rotor relative to the stator. The angled blade array may comprise a blade array body coupled to the rotor body. The angled blade may comprise a fin helically wrapped around the blade array body. The angled blade array may comprise a plurality of blades spaced around the blade array body.

The pulser assembly may further comprise a motor coupled with the driveshaft and enclosed by the housing. The motor may rotate the driveshaft and rotor relative to the stator such that the rotor projections move in and out of fluid communication with the stator flow channels to create the fluid pressure pulses.

This summary does not necessarily describe the entire scope of all aspects. Other aspects, features and advantages will be apparent to those of ordinary skill in the art upon review of the following description of specific embodiments.

DETAILED DESCRIPTION OF EMBODIMENTS

Directional terms such as "uphole" and "downhole" are used in the following description for the purpose of providing relative reference only, and are not intended to suggest any limitations on how any apparatus is to be positioned during use, or to be mounted in an assembly or relative to an environment.

The embodiments described herein generally relate to a fluid pressure pulse generator of a MWD tool that can generate pressure pulses. The fluid pressure pulse generator may be used for mud pulse ("MP") telemetry used in downhole drilling, wherein a drilling fluid (herein referred to as "mud") is used to transmit telemetry pulses to surface. The fluid pressure pulse generator may alternatively be used in other methods where it is necessary to generate a fluid pressure pulse. The fluid pressure pulse generator comprises a stator and a rotor. The stator may be fixed to a pulser assembly of the MWD tool or to a drill collar housing the MWD tool, and the rotor is fixed to a driveshaft coupled to a motor in the pulser assembly. The motor may rotate the driveshaft and rotor relative to the stator, and/or an angled blade array may be present which causes the rotor to rotate relative to the stator when mud is flowing through the fluid pressure pulse generator. The rotor rotates between an open flow position where there is no restriction of mud flowing through the fluid pressure pulse generator and no pulse is generated, and a restricted flow position where there is restriction of mud flowing through the fluid pressure pulse generator and a pressure pulse is generated.

Figure 1:
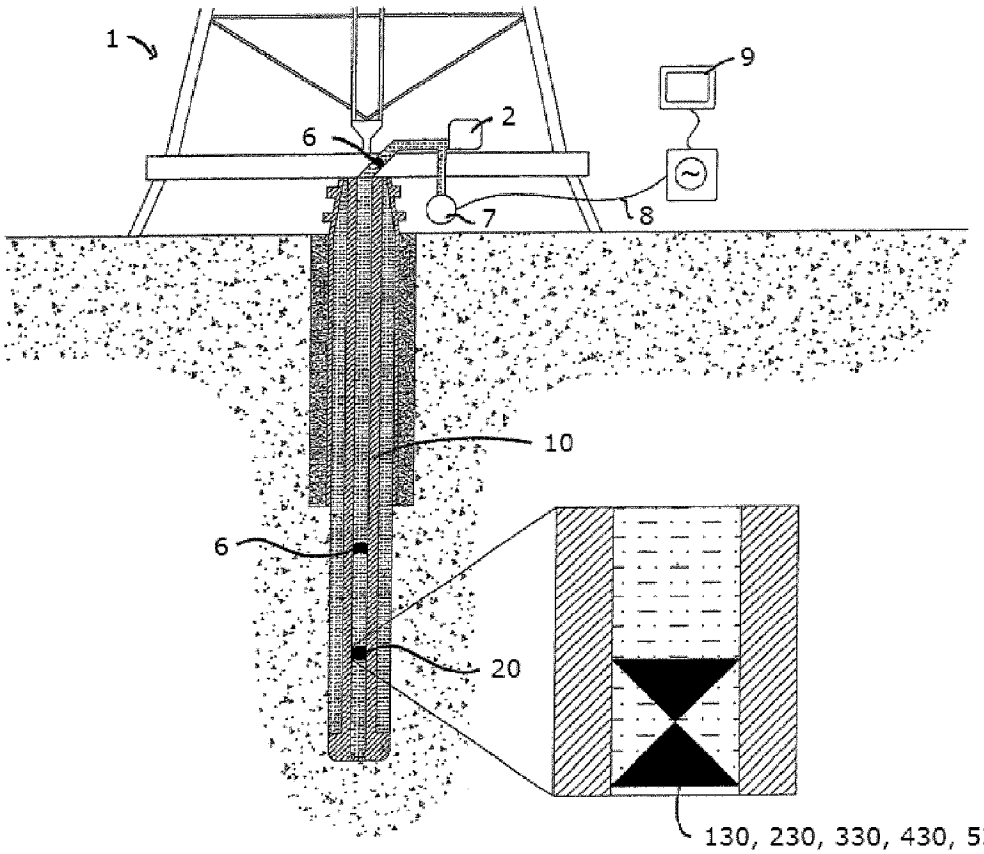
FIG. 1 is a schematic of a drill string in an oil and gas borehole comprising a MWD telemetry tool with a fluid pressure pulse generator according to different embodiments.

Referring to the drawings and specifically to FIG. 1, there is shown a schematic representation of MP telemetry operation using a fluid pressure pulse generator 130, 230, 330, 430, 530, 630, 730 according to embodiments disclosed herein. In downhole drilling equipment 1, drilling mud is pumped down a drill string by pump 2 and passes through a measurement while drilling ("MWD") tool 20 including the fluid pressure pulse generator 130, 230, 330, 430, 530, 630, 730. The fluid pressure pulse generator 130, 230, 330, 430, 530, 630, 730 has an open flow position in which mud flows relatively unimpeded through the pressure pulse generator 130, 230, 330, 430, 530, 630, 730 and no pressure pulse is generated and a restricted flow position where flow of mud through the pressure pulse generator 130, 230, 330, 430, 530, 630, 730 is restricted and a positive pressure pulse is generated (represented schematically as block 6 in mud column 10). Information acquired by downhole sensors (not shown) is transmitted in specific time divisions by pressure pulses 6 in the mud column 10. More specifically, signals from sensor modules (not shown) in the MWD tool 20, or in another downhole probe (not shown) communicative with the MWD tool 20, are received and processed in a data encoder in the MWD tool 20 where the data is digitally encoded as is well established in the art. This data is sent to a controller in the MWD tool 20 which controls timing of the fluid pressure pulse generator 130, 230, 330, 430, 530, 630, 730 to generate pressure pulses 6 in a controlled pattern which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency and these characteristics are used in various encoding systems to represent binary data.

Figure 2A:
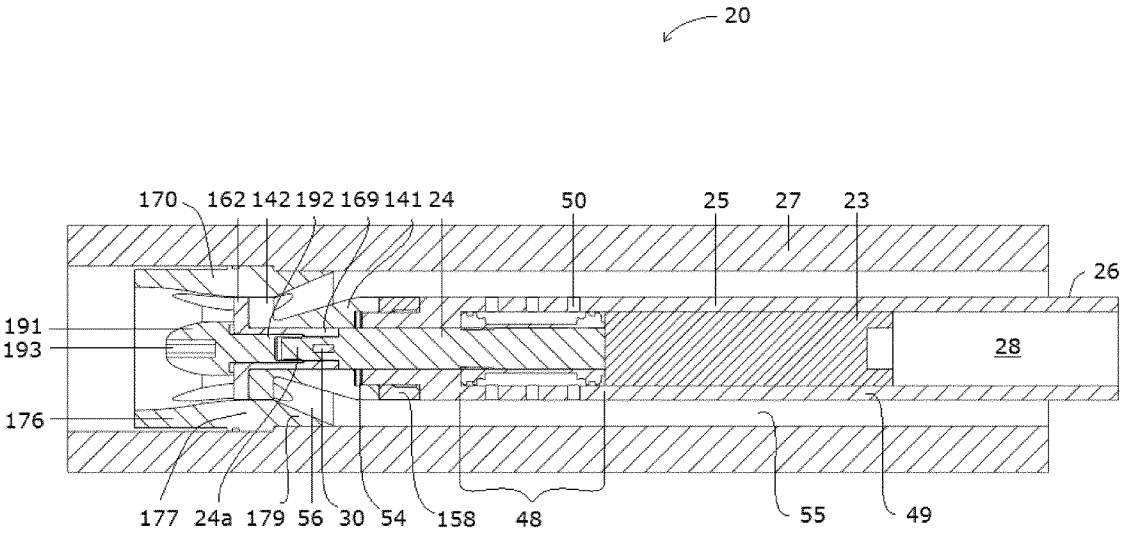
FIG. 2A is a longitudinally sectioned view of a mud pulser section of a MWD telemetry tool in a drill collar that includes a fluid pressure pulse generator with a stator and a rotor according to a first embodiment and a flow bypass sleeve according to a first embodiment that surrounds the fluid pressure pulse generator.
Figure 2B:
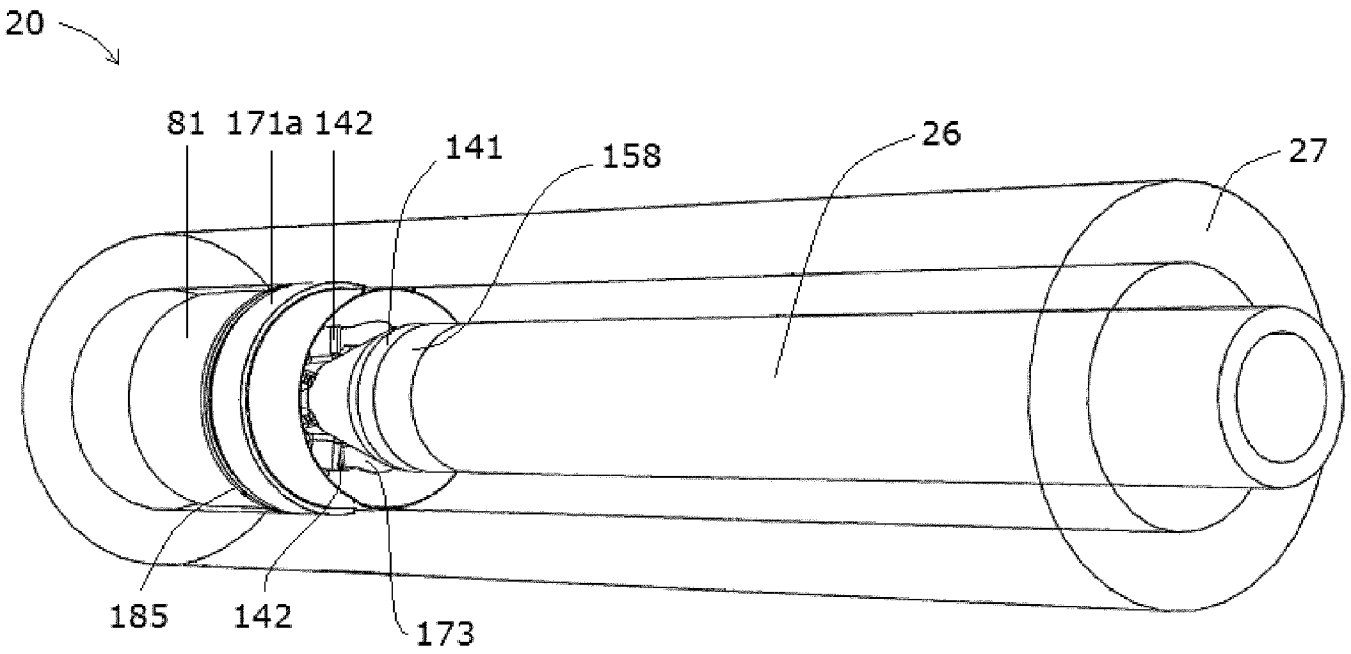
FIG. 2B is a perspective view of the mud pulser section of the MWD tool shown in FIG. 2A with the drill collar shown as transparent.
Figure 3:
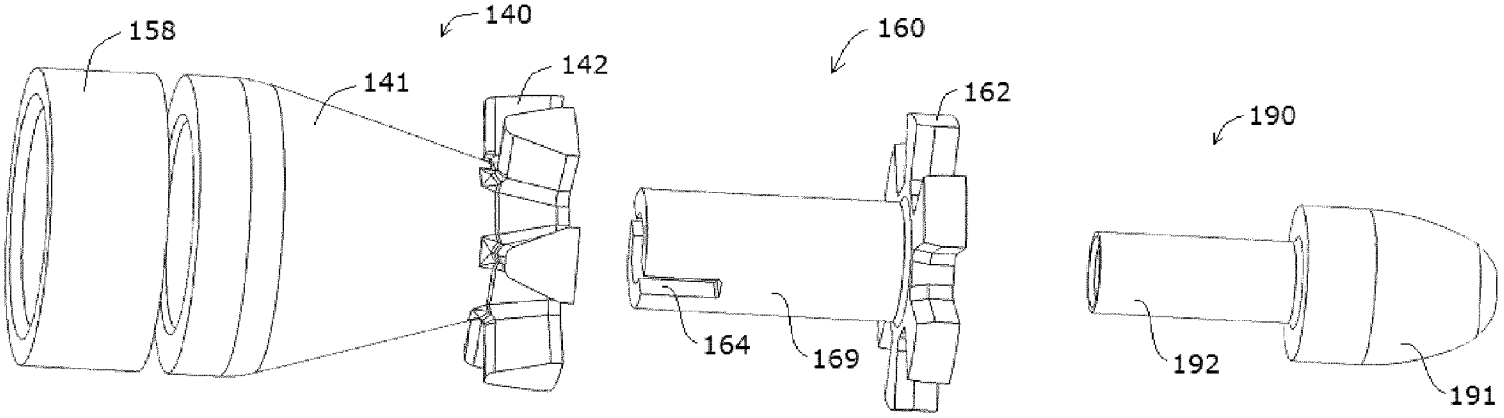
FIG. 3 is an exploded view of the fluid pressure pulse generator of the first embodiment.
Figure 4:
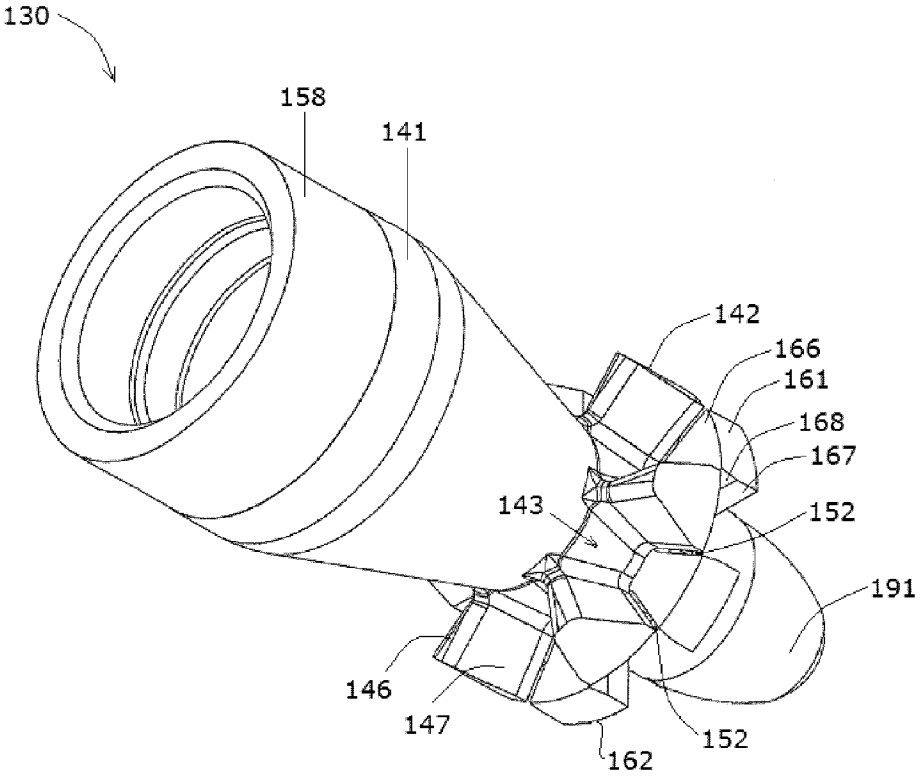
FIGS. 4 and 5 are perspective views of the fluid pressure pulse generator of the first embodiment with the rotor in a restricted flow position.
Figure 5:
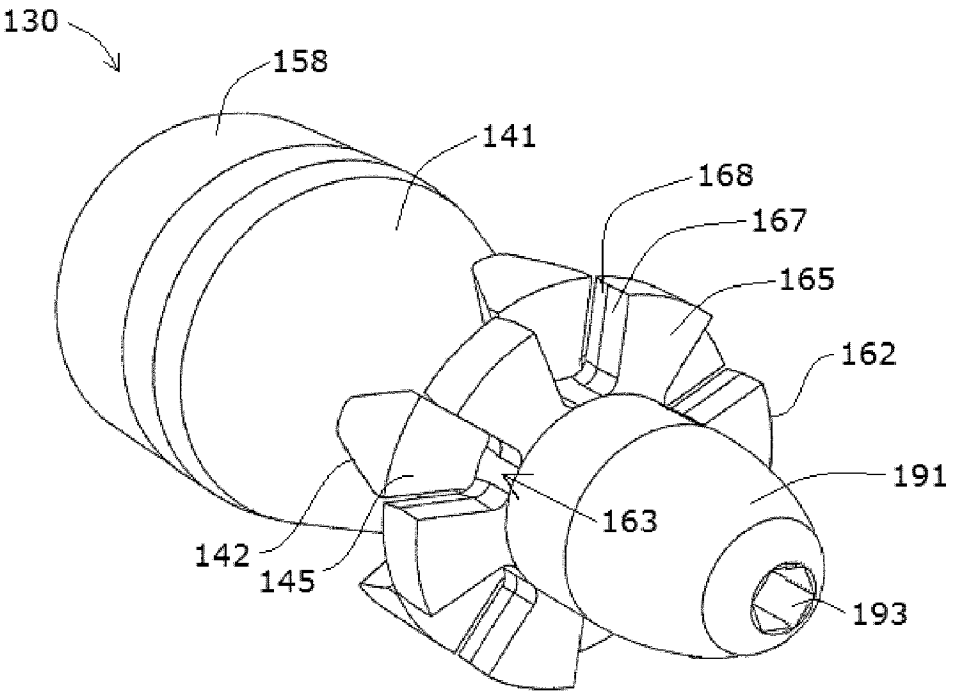
Figure 6:
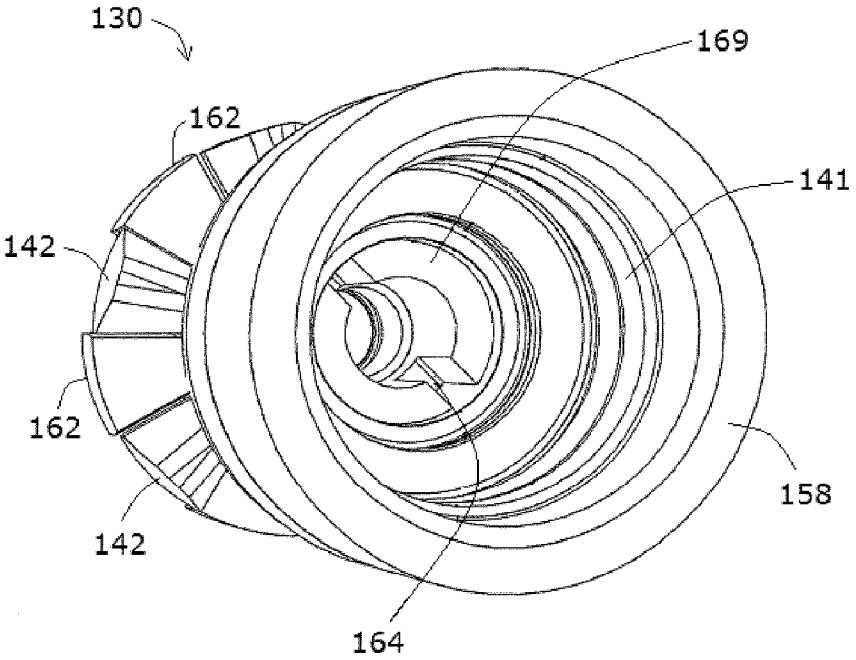
FIG. 6 is a perspective view of the uphole end of the fluid pressure pulse generator of the first embodiment with the rotor in the restricted flow position.
Figure 8A:
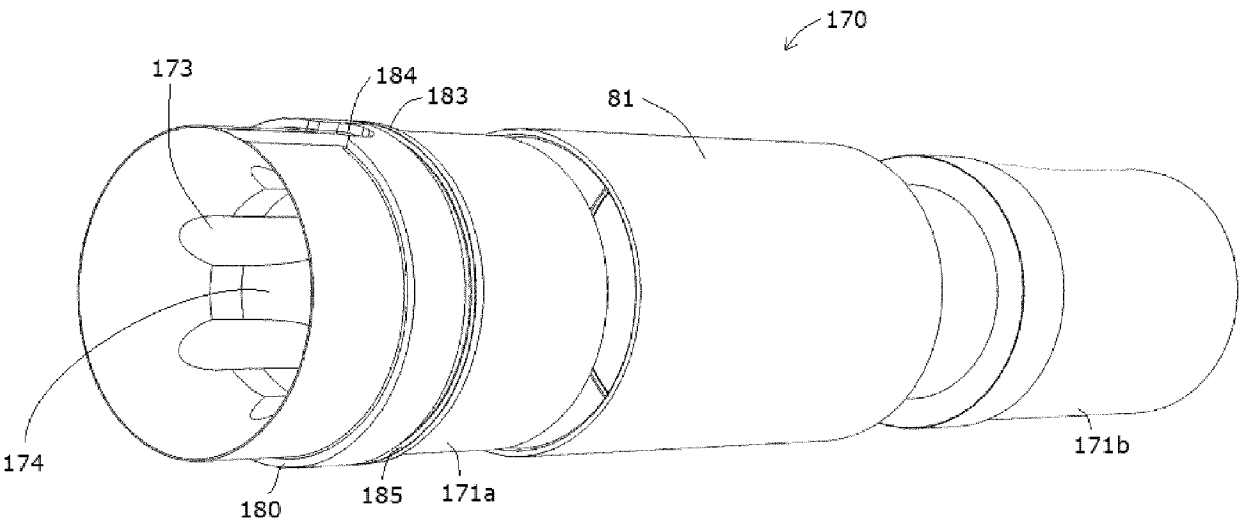
FIG. 8A is an exploded view of the flow bypass sleeve of the first embodiment.
Figure 8B:
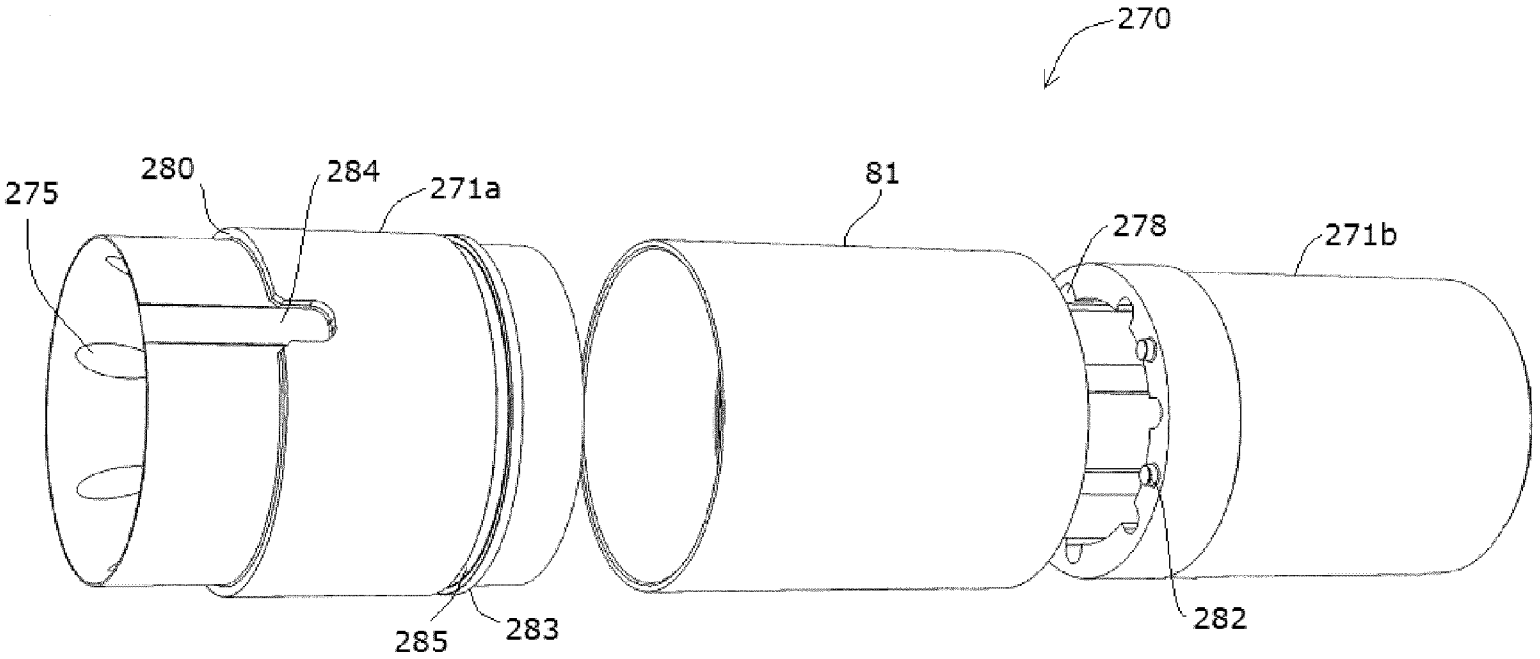
FIG. 8B is an exploded view of a flow bypass sleeve according to a second embodiment.
Figure 9:
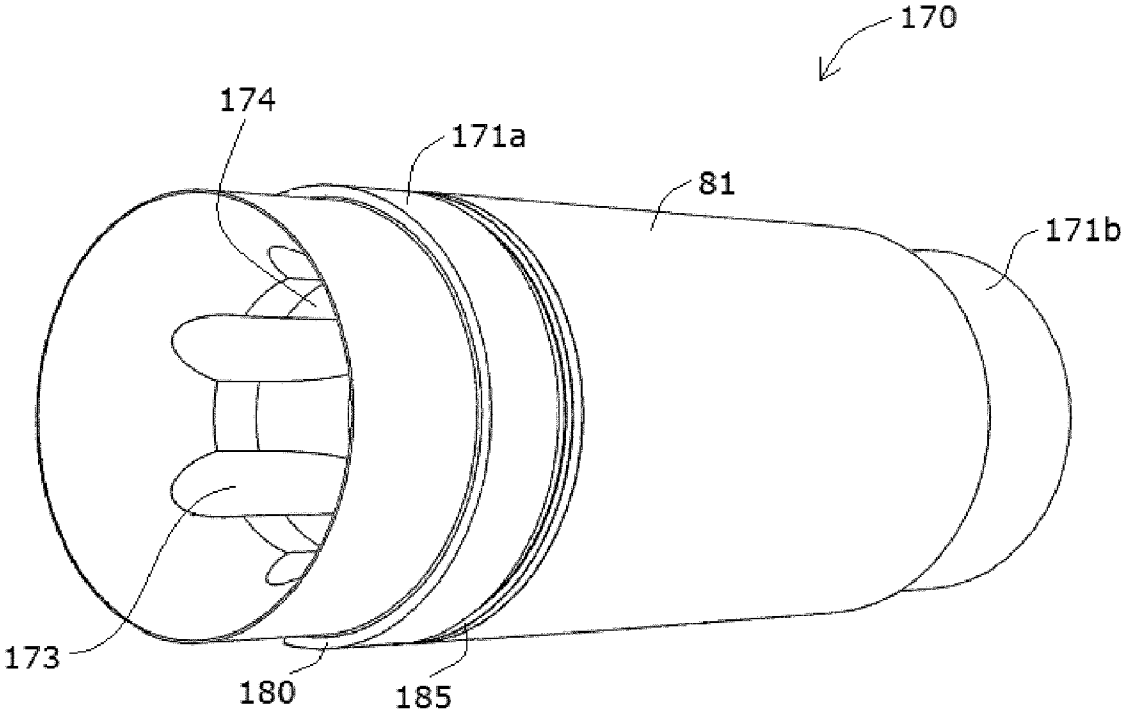
FIG. 9 is a perspective view of the flow bypass sleeve of the first embodiment.
Figure 10:
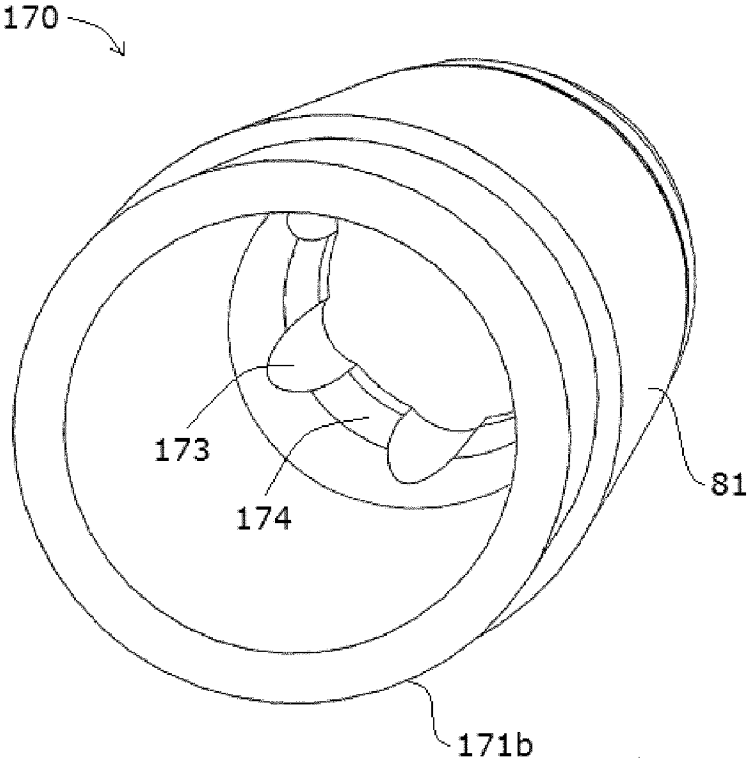
FIG. 10 is a perspective view of the downhole end of the flow bypass sleeve of the first embodiment.
Figure 11:
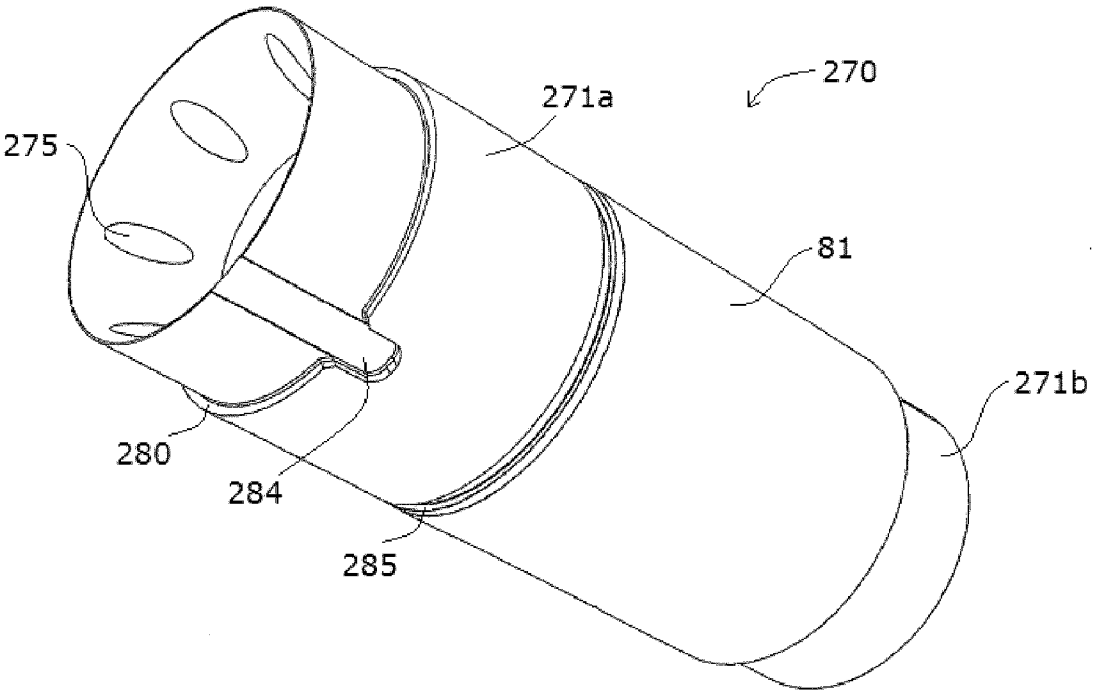
FIG. 11 is a perspective view of the flow bypass sleeve of the second embodiment.
Figure 12:
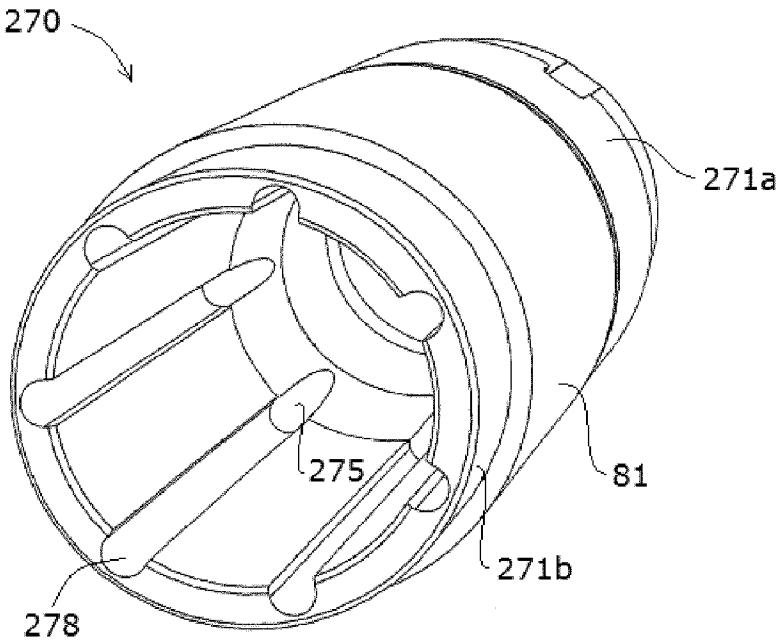
FIG. 12 is a perspective view of the downhole end of the flow bypass sleeve of the second embodiment.

Referring to FIGS. 2A and 2B, an embodiment of the MWD tool 20 is shown in more detail. The MWD tool 20 generally comprises a fluid pressure pulse generator 130 according to a first embodiment which creates fluid pressure pulses, and a pulser assembly 26 which takes measurements while drilling and which drives the fluid pressure pulse generator 130. The fluid pressure pulse generator 130 and pulser assembly 26 are axially located inside a drill collar 27. A flow bypass sleeve 170 according to a first embodiment is received inside the drill collar 27 and surrounds the fluid pressure pulse generator 130. The flow bypass sleeve 170 is described in more detail below with reference to FIGS. 8A, 9 and 10. The pulser assembly 26 is fixed to the drill collar 27 with an annular channel 55 therebetween, and mud flows along the annular channel 55 when the MWD tool 20 is downhole. The pulser assembly 26 comprises pulser assembly housing 49 enclosing a motor subassembly 25 and an electronics subassembly 28 electronically coupled together but fluidly separated by a feed-through connector (not shown). The motor subassembly 25 includes a motor and gearbox subassembly 23, a driveshaft 24 coupled to the motor and gearbox subassembly 23, and a pressure compensation device 48. As described in more detail below with reference to FIGS. 3 to 7, the fluid pressure pulse generator 130 comprises a stator 140 and a rotor 160. The stator 140 comprises a stator body 141 fixed to the pulser assembly housing 49 and stator projections 142 radially extending around the downhole end of the stator body 141. The rotor 160 comprises rotor body 169 fixed to the driveshaft 24 and rotor projections 162 radially extending around the downhole end of the rotor body 169. Rotation of the driveshaft 24 by the motor and gearbox subassembly 23 rotates the rotor 160 relative to the fixed stator 140. The electronics subassembly 28 includes downhole sensors, control electronics, and other components required by the MWD tool 20 to determine direction and inclination information and to take measurements of drilling conditions, to encode this telemetry data using one or more known modulation techniques into a carrier wave, and to send motor control signals to the motor and gearbox subassembly 23 to rotate the driveshaft 24 and rotor 160 in a controlled pattern to generate pressure pulses 6 representing the carrier wave for transmission to surface as described above.

The motor subassembly 25 is filled with a lubricating liquid such as hydraulic oil or silicon oil and this lubricating liquid is fluidly separated from mud flowing along the annular channel 55 by an annular seal 54 which surrounds the driveshaft 24. The pressure compensation device 48 comprises a flexible membrane (not shown) in fluid communication with the lubrication liquid on one side and with mud on the other side via ports 50 in the pulser assembly housing 49; this allows the pressure compensation device 48 to maintain the pressure of the lubrication liquid at about the same pressure as the mud in the annular channel 55. Without pressure compensation, the torque required to rotate the driveshaft 24 and rotor 160 would need high current draw with excessive battery consumption resulting in increased costs. In alternative embodiments (not shown), the pressure compensation device 48 may be any pressure compensation device known in the art, such as pressure compensation devices that utilize pistons, metal membranes, or a bellows style pressure compensation mechanism.

The fluid pressure pulse generator 130 is located at the downhole end of the MWD tool 20. Mud pumped from the surface by pump 2 flows along annular channel 55 between the outer surface of the pulser assembly 26 and the inner surface of the drill collar 27. When the mud reaches the fluid pressure pulse generator 130 it flows along an annular channel 56 provided between the external surface of the stator body 141 and the internal surface of the flow bypass sleeve 170. The rotor 160 rotates between an open flow position where mud flows freely through the fluid pressure pulse generator 130 resulting in no pressure pulse and a restricted flow position where flow of mud is restricted to generate pressure pulse 6, as will be described in more detail below with reference to FIGS. 3 to 7. The MWD tool 20 may be fitted with any of the embodiments of the fluid pressure pulse generator 130, 230, 330, 430, 530, 630, 730 disclosed herein.

Referring to FIGS. 3 to 7, the first embodiment of the fluid pressure pulse generator 130 comprising stator 140 and rotor 160 is shown in more detail. The stator 140 comprises longitudinally extending stator body 141 with a central bore therethrough. The stator body 141 comprises a cylindrical section at the uphole end and a generally frusto-conical section at the downhole end which tapers longitudinally in the downhole direction. As shown in FIGS. 2A and 2B, the cylindrical section of stator body 141 is coupled with the pulser assembly housing 49. More specifically, a jam ring 158 threaded on the stator body 141 is threaded onto the pulser assembly housing 49. Once the stator 140 is positioned correctly, the stator 140 is held in place and the jam ring 158 is backed off and torqued onto the stator 140 holding it in place. As shown in FIG. 2A, the stator body 141 surrounds annular seal 54. A small amount of mud may be able to enter the fluid pressure pulse generator 130 between the rotor 160 and the stator 140 however this entry point is downhole from annular seal 54 so the mud has to travel uphole against gravity to reach annular seal 54. The velocity of mud impinging on annular seal 54 may therefore be reduced and there may be less wear of seal 54 compared to other rotor/stator designs. The external surface of the pulser assembly housing 49 is flush with the external surface of the cylindrical section of the stator body 141 for smooth flow of mud therealong. In alternative embodiments (not shown) other means of coupling the stator 140 with the pulser assembly housing 49 may be utilized and the external surface of the stator body 141 and the pulser assembly housing 49 may not be flush.

A plurality of radially extending projections 142 are spaced equidistant around the downhole end of the stator body 141. Each stator projection 142 is tapered and narrower at its proximal end attached to the stator body 141 than at its distal end. The stator projections 142 have a radial profile with an uphole end 146 and a downhole face 145, with two opposed side faces 147 extending therebetween. A section of the radial profile of each stator projection 142 is tapered towards the uphole end 146 such that the uphole end 146 is narrower than the downhole face 145. The stator projections 142 have a rounded uphole end 146 and most of the stator projection 142 tapers towards the rounded uphole end 146.

Mud flowing along the external surface of the stator body 141 contacts the uphole end 146 of the stator projections 142 and flows through stator flow channels 143 defined by the side faces 147 of adjacently positioned stator projections 142. The stator flow channels 143 are curved or rounded at their proximal end closest to the stator body 141. The curved stator flow channels 143, as well as the tapered section and rounded uphole end 146 of the stator projections 142 may provide smooth flow of mud through the stator flow channels 143 and may reduce wear of the stator projections 142 caused by erosion. In alternative embodiments (not shown) none or only some of the stator projections 142 may be tapered towards the uphole end 146. The stator projections 142 and thus the stator flow channels 143 defined therebetween may be any shape and dimensioned to direct flow of mud through the stator flow channels 143.

The rotor 160 comprises generally cylindrical rotor body 169 with a central bore therethrough and a plurality of radially extending projections 162. As shown in FIG. 2A, the rotor body 169 is received in the downhole end of the bore in the stator body 141. A downhole shaft 24*a* of the driveshaft 24 is received in uphole end of the bore in the rotor body 169 and a coupling key 30 extends through the driveshaft 24 and is received in a coupling key receptacle 164 at the uphole end of the rotor body 169 to couple the driveshaft 24 with the rotor body 169. A rotor cap 190 comprising a cap body 191 and a cap shaft 192 is positioned at the downhole end of the fluid pressure pulse generator 130. The cap shaft 192 is received in the downhole end of the bore in the rotor body 169 and threads onto the downhole shaft 24*a* of the driveshaft 24 to lock (torque) the rotor 160 to the driveshaft 24. The cap body 191 includes a hexagonal shaped opening 193 dimensioned to receive a hexagonal Allen key which is used to torque the rotor 160 to the driveshaft 24. The rotor cap 190 therefore releasably couples the rotor 160 to the driveshaft 24 so that the rotor 160 can be easily removed and repaired or replaced if necessary using the Allen key. The rounded cone shaped cap body 191 may provide a streamlined flow path for mud and may reduce wear of the rotor projections 162 caused by recirculation of mud. The rounded cap body 191 may also reduce torque required to rotate the rotor 160 by reducing turbulence downhole of the rotor 160. Positioning the rotor body 169 in the bore of the stator body 141 may protect the rotor body 169 from wear caused by mud erosion.

The radially extending rotor projections 162 are equidistantly spaced around the downhole end of the rotor body 169 and are axially adjacent and downhole relative to the stator projections 142 in the assembled fluid pressure pulse generator 130. The rotor projections 162 rotate in and out of fluid communication with the stator flow channels 143 to generate pressure pulse 6 as described in more detail below. Each rotor projection 162 has a radial profile including an uphole face 166 and a downhole face 165, with two opposed side faces 167 and an end face 161 extending between the uphole face 166 and the downhole face 165. Each rotor projection 162 is tapered and narrower at its proximal end attached to the rotor body 169 than at its distal end. Each side face 167 has a bevelled or chamfered uphole edge 168 which is angled inwards towards the uphole face 166 such that an uphole section of the radial profile of each of the rotor projections 162 tapers in an uphole direction towards the uphole face 166.

Figure 7:
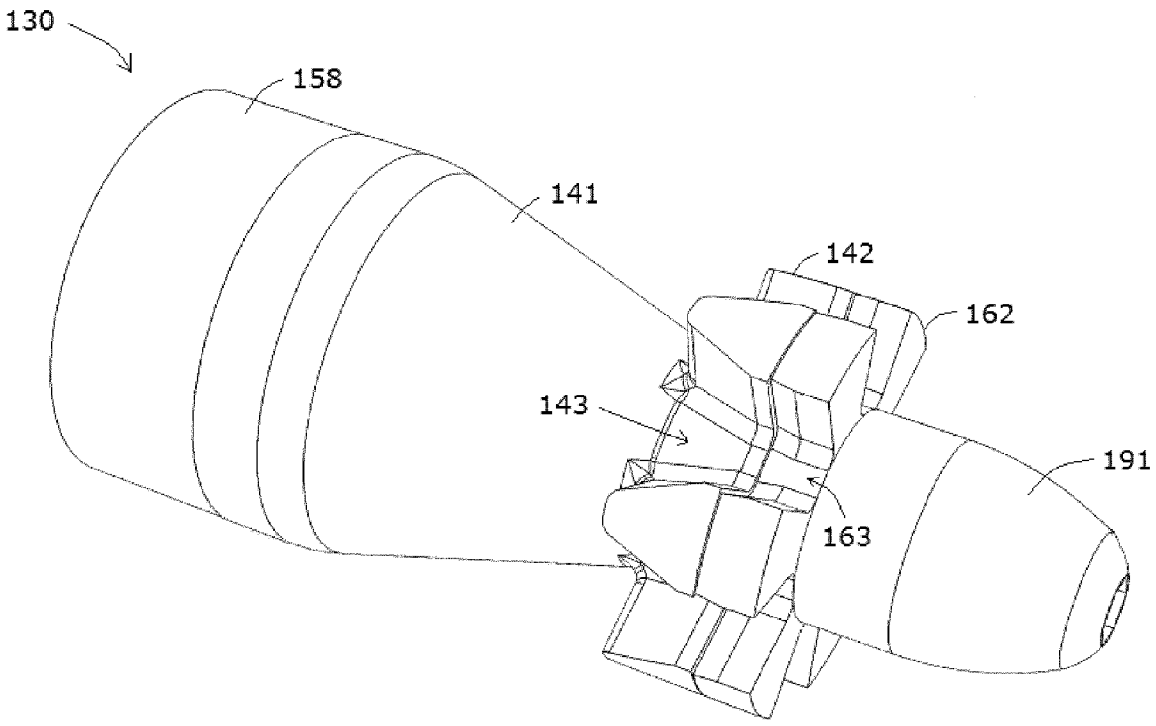
FIG. 7 is a perspective view of the fluid pressure pulse generator of the first embodiment with the rotor in an open flow position.

In use the rotor projections 162 align with the stator projections 142 when the rotor 160 is in the open flow position shown in FIG. 7 and mud flows freely through the stator flow channels 143 and rotor flow channels 163 defined by adjacent rotor projections 162, resulting in no pressure pulse. The rotor flow channels 163 are curved or rounded at the proximal end closest to the rotor body 169 for smooth flow of mud therethrough which may reduce wear of the rotor projections 162. Positioning the stator projections 142 uphole of the rotor projections 162 may protect the rotor projections 162 from wear as they are protected from mud flow by the stator projections 142 when the rotor 160 is in the open flow position. To generate pressure pulses 6, the rotor 160 rotates to the restricted flow position shown in FIG. 4 where the rotor projections 162 align with the stator flow channels 143. Gaps 152 between the rotor side faces 167 and the stator side faces 147 allow some mud to flow from the stator flow channels 143 to the rotor flow channels 163 when the rotor 160 is in the restricted flow position; however, the overall volume of mud flowing through the fluid pressure pulse generator 130 when the rotor 160 is in the restricted flow position is reduced compared to the overall volume of mud flowing through the fluid pressure pulse generator 130 when the rotor 160 is in the open flow position resulting in pressure pulse 6. The rotor projections 162 rotate in and out of fluid communication with the stator flow channels 143 in a controlled pattern to generate pressure pulses 6 representing the carrier wave for transmission to surface.

The bevelled edges 168 of the side faces 167 of the rotor projections 162 provide a self correction mechanism to move the rotor 160 to the open flow position shown in FIG. 7 if there is failure of the motor and gearbox subassembly 23, driveshaft 24 or any other component of the MWD tool 20 that results in rotation of the rotor 160 stopping during downhole operation. More specifically, if the pulser assembly 26 fails when the rotor 160 is transitioning between the open and restricted flow positions, mud impinging on the bevelled edges 168 of the rotor projections 162 causes the rotor projections 162 to move in an anticlockwise or clockwise direction until the rotor 160 reaches the open flow position. Furthermore, if the pulser assembly 26 fails when the rotor 160 is in the restricted flow position shown in FIG. 4, mud flowing through gaps 152 will impinge on the bevelled edges 168 of the rotor projections 162 and cause the rotor projections 162 to move in an anticlockwise or clockwise direction until the rotor 160 reaches the open flow position. The tapered stator projections 142 may direct mud towards the bevelled edges 168 of the rotor projections 162 and may increase the rotational force created by mud impinging on the bevelled edges 168. The direction of movement of the rotor 160 depends on the direction of the angle of the bevelled edges 168 upon which the mud is impinging. When the rotor 160 reaches the open flow position, the bevelled edges 168 are positioned below the stator projections 142 and out of the mud flow path so the rotor 160 remains stationary in the open flow position until the pulser assembly 26 is fixed or replaced and rotation of the rotor 160 continues.

In alternative embodiments (not shown), the angle of the bevelled edge 168 of one of the side faces 167 of each rotor projection 162 may be different to the angle of the bevelled edge 168 of the other side face 167. Provision of different angles for the bevelled edges 168 on the opposed side faces 167 of each rotor projection 162 may allow for self correction of the rotor 160 when both of the bevelled edges 168 of each rotor projection 162 align with the stator flow channels 143 (i.e. the rotor 160 is in the restricted flow position shown in FIG. 4 and not transitioning between the restricted flow position and the open flow position). As the angle is different for each bevelled edge 168 the rotational force created by mud impinging on one of the bevelled edge 168 may be greater than the rotation force created by mud impinging on the other bevelled edge 168 and the rotor 160 moves to the open flow position. In an alternative embodiment of the rotor 160, only some of the rotor projections 162 may have bevelled edges 168 with different angles and the rest of the rotor projections 162 may have bevelled edges 168 with the same angle, or only one of the side faces 167 may have a bevelled edge 168. In an alternative embodiment of the rotor 160, a first group of the rotor projections 162 may have a bevelled edge 168 on the left hand side face 167 only whilst a second group of the rotor projections 162 may have a bevelled edge 168 on the right hand side face 167 only, with the number of rotor projections 162 in the first group being different to the number of rotor projections 162 in the second group. In this alternative embodiment, the rotational force of mud impinging on the bevelled edges 168 of the rotor projections 162 in the larger group may be greater than the rotational force of mud impinging on the bevelled edges 168 of the rotor projections 162 of the smaller group allowing the rotor 160 to self correct to the open flow position. When the one direction oscillation method described below is used for rotation of the rotor 160 during operation, only the leading side face 167 of each rotor projection 162 may have a bevelled edge 168. The leading side face 167 will be in the mud flow path when the rotor 160 is transitioning between the open and restricted flow positions and mud impinging on the bevelled edge 168 of the leading side face 167 moves the rotor 160 to the open flow position following failure of the pulser assembly 26. The innovative aspects apply equally in embodiments such as these.

Rotational force provided by the motor and gearbox subassembly 23 is required to rotate the rotor 160 to the restricted flow position. Provision of the bevelled edges 168 causes the rotor 160 to self correct and move to the open flow position if the applied rotational force stops. The rotor 160 remains in the open flow position until the rotational force is applied again. Providing a self-correcting rotor 160 that moves to the open flow position if there is failure of the pulser assembly 26 may reduce pressure build up caused by the rotor 160 being held in the restricted flow position, or partial restricted flow position for an extended period of time following failure of the pulser assembly 26. Without self-correction, the pressure build up could lead to damage of the rotor 160 and/or stator 140. The pressure build up could also lead to failure of the pumps or piping on surface. Furthermore, self correction of the rotor 160 to the open flow position may reduce or prevent debris or lost circulation material (LCM) build up which could plug the drill collar 27 and restrict mud flow. The tapered radial profile of the rotor projections 162 may also reduce the torque required to rotate the rotor 160 from the restricted flow position to the open flow position during normal operation.

In alternative embodiments (not shown), the fluid pressure pulse generator 130 may be positioned at the uphole end of the MWD tool 20. The fluid pressure pulse generator 130 may be positioned at the uphole end of the pulser assembly 26 with the rotor projections 162 axially adjacent and downhole of the stator projections 142, such that the tapered section of the rotor projections 162 functions as a self correction mechanism to move the rotor 160 to the open flow position if there is failure of the pulser assembly 26. The innovative aspects apply equally in embodiments such as these.

In order to generate fluid pressure pulses 6 a controller (not shown) in the electronics subassembly 28 sends motor control signals to the motor and gearbox subassembly 23 to rotate the driveshaft 24 and rotor 160 in a controlled pattern using one of the following methods of rotation:

One Direction Clockwise-Anticlockwise Oscillation

The rotor 160 starts in the open flow position shown in FIG. 7 where the rotor flow channels 163 align with the stator flow channels 143 and there is no pressure pulse. The rotor 160 then rotates clockwise to the restricted flow position shown in FIG. 4 where the rotor projections 162 align with the stator flow channels 143 and the flow of mud is restricted which generates pressure pulse 6. The rotor 160 then rotates anticlockwise back to the start (open) position where there is no pressure pulse. This clockwise-anticlockwise oscillation is repeated in a controlled pattern to generate pressure pulses 6.

One Direction Anticlockwise-Clockwise Oscillation

The rotor 160 starts in the open flow position shown in FIG. 7 where the rotor flow channels 163 align with the stator flow channels 143 and there is no pressure pulse. The rotor 160 then rotates anticlockwise to the restricted flow position shown in FIG. 4 where the rotor projections 162 align with the stator flow channels 143 and the flow of mud is restricted which generates pressure pulse 6. The rotor 160 then rotates clockwise back to the start (open) position where there is no pressure pulse. This anticlockwise-clockwise oscillation is repeated in a controlled pattern to generate pressure pulses 6.

Dual Direction Oscillation

The rotor 160 starts in the open flow position shown in FIG. 7 where the rotor flow channels 163 align with the stator flow channels 143 and there is no pressure pulse. The rotor 160 can then rotate either clockwise or anticlockwise from the start (open) position to the restricted flow position shown in FIG. 4 to generate pressure pulses 6, each time rotating back in the opposite direction to the same start (open) position before the next rotation in either the clockwise or anticlockwise direction.

Continuous One Direction Rotation

The rotor 160 rotates continuously in one direction (either clockwise or anticlockwise) moving between the open and restricted flow positions to generate pressure pulses 6. The direction of continuous rotation may be regularly changed to reduce wear caused by long term rotation in one direction only.

In the one direction and dual direction oscillation methods described above, the rotor 160 is oscillated clockwise and anticlockwise, and there may be less likelihood of wear than the continuous one direction rotation method where the rotor 160 is rotated in one direction only before the direction of rotation may be changed. Furthermore, in the oscillation methods the span of rotation is limited compared to continuous rotation, which may reduce wear of the motor, seals and other components associated with rotation.

It will be evident from the foregoing that provision of more stator projections 142 and rotor projections 162 will reduce the amount of rotation required to move the rotor 160 between the open and restricted flow positions, thereby increasing the speed of data transmission; however the number of stator projections 142 and rotor projections 162 may be limited by the circumferential area of the stator body 141 and rotor body 169 being able to accommodate the stator projections 142 and rotor projections 162 respectively. In order to accommodate more stator projections 142 and rotor projections 162 if data transmission speed is an important factor, the width of the stator projections 142 and rotor projections 162 can be decreased to allow for more stator projections 142 and rotor projections 162 to be present, however this may make the stator projections 142 and rotor projections 162 more fragile and prone to wear.

Provision of multiple stator projections 142 and rotor projections 162 provides redundancy and allows the fluid pressure pulse generator 130 to continue working when there is damage to one of the stator projections 142 and/or rotor projections 162 or blockage of one of the stator flow channels 143 and/or rotor flow channels 163. Cumulative flow of mud through the remaining undamaged or unblocked stator flow channels 143 and/or rotor flow channels 163 may still result in generation of detectable pressure pulses 6, even though the pulse heights may not be the same as when there is no damage or blockage.

In an alternative embodiment (not shown), the rotor projections 162 may be narrower than the stator projections 142 and the gap 152 between one or both of the rotor side faces 167 and the stator projections 142 when the rotor 160 is in the restricted flow position may be increased. The gap 152 may also be increased by increasing the angle of the bevelled edges 168 of the rotor side faces 167. This results in more mud flowing from the stator flow channels 143 to the rotor flow channels 163 when the rotor 160 is in the restricted flow position; however the rotor projections 162 still rotate in and out of fluid communication with the stator flow channels 143 to generate pressure pulses 6. In a further alternative embodiment (not shown), the outer diameter of the rotor projections 162 may be less than the outer diameter of the stator projections 142 such that an additional gap or bypass channel is present between the end face 161 of the rotor projections 162 and the internal surface of the flow bypass sleeve 170, or between the end face 161 of the rotor projections 162 and the internal surface of the drill collar 27 when there is no flow bypass sleeve 170 present. Mud flows through this bypass channel when the rotor 160 is in the restricted flow position. In these embodiments the volume of mud flowing through the pressure pulse generator 130 may be increased and the flow bypass sleeve 170 may be adapted such that the volume of mud flowing through the flow bypass sleeve 170 is reduced, or no flow bypass sleeve 170 may be required.

In a further alternative embodiment (not shown), the rotor 160 may rotate between different restricted flow positions to generate different sized pressure pulses. For example, the rotor 160 may rotate from the open flow position in one direction to a first restricted flow position then back to the open flow position to generate a first pressure pulse and also rotate in the opposite direction to a second restricted flow position then back to the open flow position to generate a second pressure pulse using the dual direction oscillation method described above. The gap 152 between one or both of the rotor side faces 167 and the stator projections 142 in the first restricted flow position may be greater than the gap 152 in the second restricted flow position, such that a greater volume of mud flows through the gap 152 in the first restricted flow position than in the second restricted flow position and the pulse height of the first pressure pulses will be less than the pulse height of the second pressure pulses. In this alternative embodiment, the radial profile of the rotor projections 162 may be tapered in the uphole direction to allow for self correction of the rotor 160 to the open flow position if rotation is stopped when the rotor 160 is in the first or second restricted flow positions or transitioning between the restricted flow position and the open flow position. The innovative aspects apply equally in embodiments such as these.

Referring to FIGS. 15 to 19 a second embodiment of a fluid pressure pulse generator 230 comprising a stator 240 and a rotor 260 is shown. The stator 240 comprises a longitudinally extending stator body 241 with a central bore therethrough and a plurality of radially extending projections 242 spaced equidistant around the downhole end of the stator body 241. The stator projections 242 have a radial profile with a flat uphole face 246 and a flat downhole face, with two opposed side faces 247 extending therebetween. Each side face 247 has a bevelled or chamfered uphole edge 247*a* providing a tapered section which tapers in the uphole direction towards the uphole face 246. Mud flowing along the external surface of the stator body 241 contacts the uphole face 246 of the stator projections 242 and flows through stator flow channels 243 defined by the side faces 247 of adjacently positioned stator projections 242.

The rotor 260 comprises a generally cylindrical rotor body 269 with a central bore therethrough and a plurality of radially extending projections 262 spaced equidistant around the downhole end of the rotor body 269. The rotor projections 262 are axially adjacent and downhole to the stator projections 242 in the assembled fluid pressure pulse generator 230. The rotor projections 262 rotate in and out of fluid communication with stator flow channels 243 to generate pressure pulses 6. Each rotor projection 262 has a radial profile including an uphole face 266 and a downhole face, with two opposed side faces 267 and an end face 261 extending between the uphole face 266 and the downhole face. The side faces 267 have a bevelled or chamfered uphole edge 268 which is angled inwards towards the uphole face 266 such that an uphole section of the radial profile of each of the rotor projections 262 tapers in an uphole direction towards the uphole face 266. Side faces 267 of adjacent rotor projections 262 define rotor flow channels 263 which align with the stator flow channels 243 when the rotor 260 is in the open flow position shown in FIG. 15B.

The rotor projections 262 each have a bypass channel 295 comprising a semi-circular groove in the end face 261. The bypass channels 295 have an axial inlet and an axial outlet and mud flows from the stator flow channels 243 through the bypass channels 295 when the rotor 260 is in the restricted flow position shown in FIG. 15A. The semi-circular geometry of the bypass channels 295 may reduce erosion caused by mud compared to geometries that have corners; however, in alternative embodiments, the bypass channels 295 may be any shaped channel that allows mud to flow from the uphole side to the downhole side of the rotor projections 262 when the rotor 260 is in the restricted flow position. For example, the bypass channels 295 may be an aperture through the rotor projections 262 extending from the uphole face 266 to the downhole face.

A rotor cap 290 comprising a cap body 291 and a cap shaft (not shown) releasably couples the rotor body 269 to the driveshaft 24 of the MWD tool 20. The cap body 261 includes a hexagonal shaped opening 293 (shown in FIG. 19) dimensioned to receive a hexagonal Allen key which is used to torque the rotor 260 to the driveshaft 24 as described above in more detail with reference to FIGS. 2 to 7.

Figure 15A:
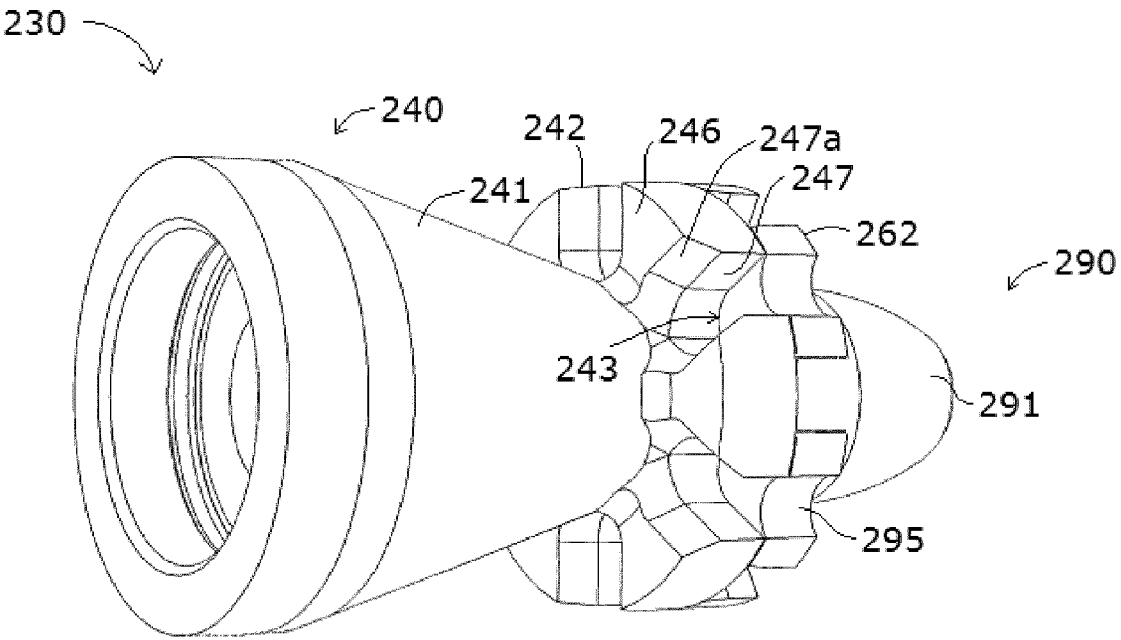
FIGS. 15A and 15B are perspective views of a fluid pressure pulse generator according to a second embodiment comprising a rotor and a stator, with the rotor in the restricted flow position (FIG. 15A) and in an open flow position (FIG. 15B).
Figure 15B:
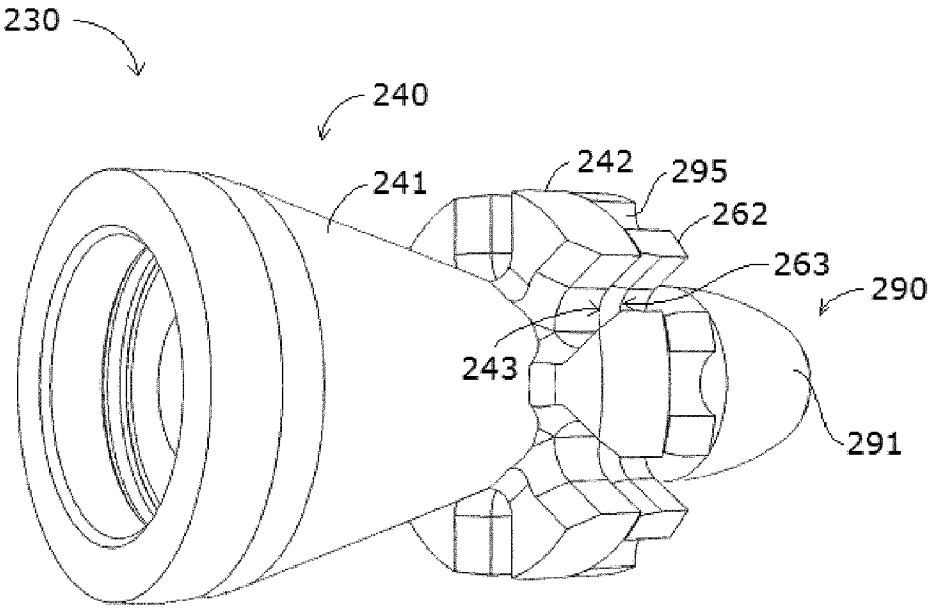
Figure 16:
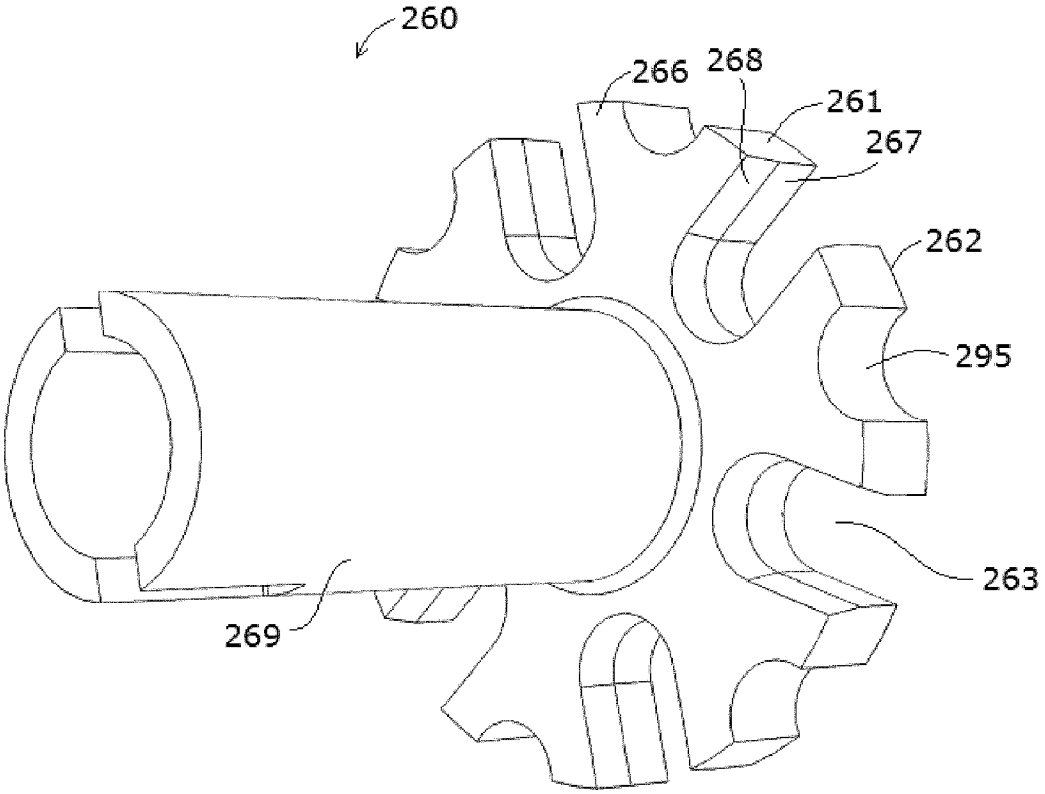
FIG. 16 is a perspective view of the rotor of the fluid pressure pulse generator of the second embodiment.

The rotor projections 262 are wider than the stator flow channels 243, such that a portion of two adjacent stator projections 242 overlie an underlying rotor projection 262 when the rotor 260 is in the restricted flow position shown in FIG. 15A. The leading side face 267 of each rotor projection 262 intersects the side face 247 of one of the stator projections 242 as the rotor 260 transitions from the open flow position to the restricted flow position as shown in FIG. 19C. This may provide a cutting action to cut through debris or lost circulation material (LCM) that may have built up in the stator flow channels 243 which may dislodge any debris and LCM stuck in the stator flow channels 243 and may reduce blockage of the stator flow channels 243 which could lead to restricted mud flow. The overlying rotor and stator projections 262, 242 may also reduce the requirement for such precision rotation of the rotor 260 as needed for the first embodiment of the fluid pressure pulse generator 130 disclosed above. The degree of rotational tolerance may depend on the amount of overlap of the stator and rotor projections 242, 262.

In the second embodiment of the fluid pressure pulse generator 230, the self-correction mechanism will be activated if the pulser assembly 26 fails when the rotor 260 is transitioning between the open and restricted flow positions and the bevelled edges 268 of the rotor projections 262 are in the mud flow path. As described in more detail above with reference to FIGS. 3 to 7, mud impinging on the bevelled edges 268 causes the rotor 260 to rotate to the open flow position shown in FIG. 15B if there is failure of the pulser assembly 26. If the pulser assembly 26 fails when the rotor 260 is in the restricted flow position shown in FIG. 15A, the bevelled edges 268 are below the stator projections 242 and not in the mud flow path and the self-correction mechanism will not be activated; however, the bypass channels 295 allow some mud to flow through the fluid pressure pulse generator 230 to reduce pressure build up.

Figure 20B:
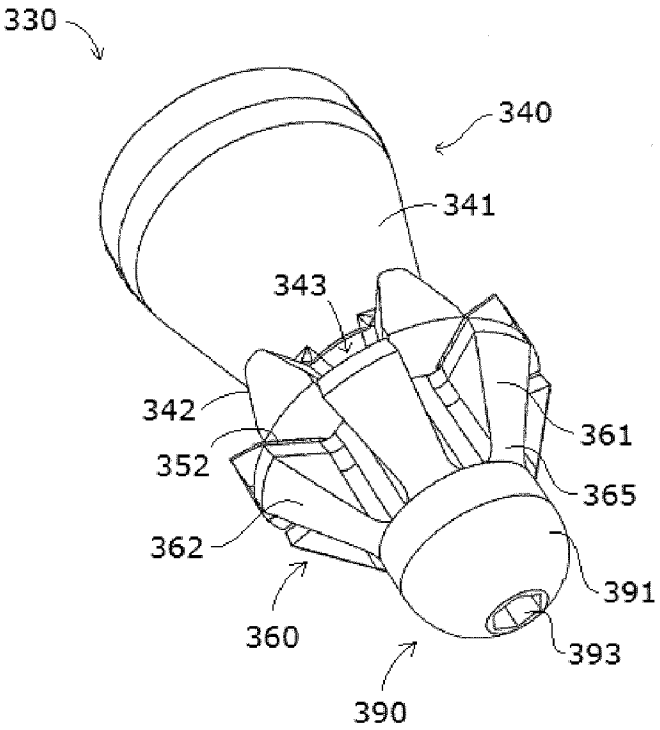
FIGS. 20A and 20B are perspective views of a fluid pressure pulse generator according to a third embodiment comprising a rotor and a stator, with the rotor in an open flow position (FIG. 20A) and in a restricted flow position (FIG. 20B).
Figure 20A:
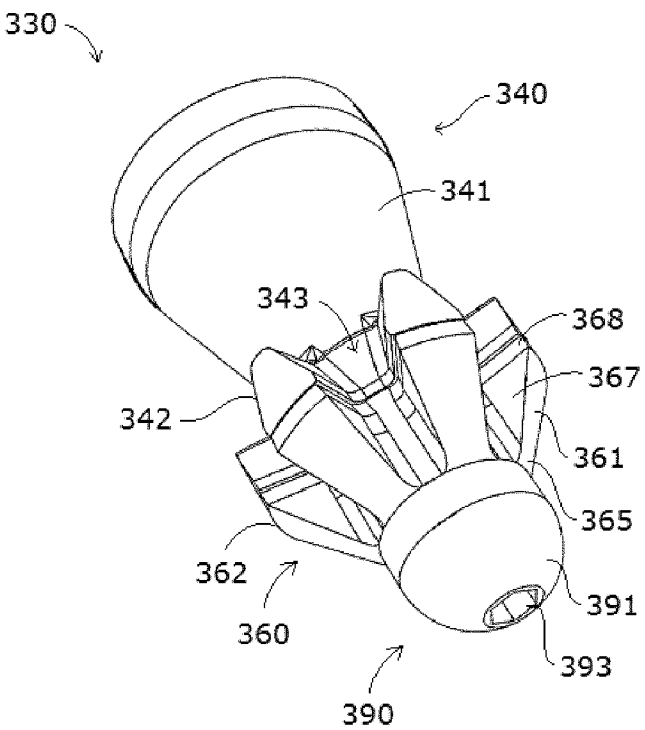

Referring to FIGS. 20A and 20B a third embodiment of a fluid pressure pulse generator 330 is shown comprising a stator 340 and a rotor 360. Stator 340 is similar to stator 140 of the first embodiment of the fluid pressure pulse generator 130 and comprises a longitudinally extending stator body 341 with a central bore therethrough and a plurality of radially extending projections 342 spaced equidistant around the downhole end of the stator body 341. The stator projections 342 define stator flow channels 343 therebetween.

Rotor 360 comprises a generally cylindrical rotor body (not shown) with a central bore therethrough and a plurality of radially extending rotor projections 362 spaced equidistant around the downhole end of the rotor body. Each rotor projection 362 has a radial profile with an uphole face and a downhole end 365, with two opposed side faces 367 and an end face 361 extending between the uphole face and the downhole end 365. The side faces 367 have a bevelled or chamfered uphole edge 368 which is angled inwards towards the uphole face such that an uphole section of the radial profile of each of the rotor projections 362 tapers in an uphole direction towards the uphole face. A downhole section of the radial profile of each of the rotor projections 362 tapers in the downhole direction towards the downhole end 365, such that the width of the end face 361 tapers towards the downhole end 365. The width of the end face 361 is therefore widest at a point in between the uphole face and the downhole end 365 of the rotor projections 362 and the width of the end face 361 tapers from this widest point in both the uphole and downhole directions. In addition, each rotor projection 362 tapers radially in the downhole direction, such that the radial thickness of the uphole face is greater than the radial thickness of the downhole end 365 giving the rotor projections 362 their wedge like shape. The wedge shaped rotor projections 362 therefore taper both along their axis and radially and are longitudinally extended compared to the rotor projections 162 and 262 of the first and second embodiments of the fluid pressure pulse generator 130 and 230.

A rotor cap 390 comprising a cap body 391 and a cap shaft (not shown) releasably couples the rotor 360 to the driveshaft 24 of the MWD tool 20. The cap body 391 has a hexagonal shaped opening 393 dimensioned to receive a hexagonal Allen key which is used to torque the rotor 360 to the driveshaft 24 as described above in more detail with reference to FIGS. 2 to 7. The cap body 391 of rotor cap 390 is shorter longitudinally compared to the cap body 191, 291 of the rotor cap 190, 290 of the first and second embodiments of the fluid pressure pulse generator 130, 230 as the rotor 360 is extended longitudinally as a result of the longitudinally extending wedge shaped projections 362.

As described above with reference to FIGS. 3 to 7, if the pulser assembly 26 fails when the rotor 360 is transitioning between the open and restricted flow positions, mud impinging on the bevelled edges 368 of the rotor projections 362 causes the rotor projections 362 to move in an anticlockwise or clockwise direction until the rotor 360 reaches the open flow position. Furthermore, if the pulser assembly 26 fails when the rotor 360 is in the restricted flow position shown in FIG. 20B, mud flowing through gaps 352 will impinge on the bevelled edges 368 of the rotor projections 362 and cause the rotor projections 362 to move in an anticlockwise or clockwise direction until the rotor 360 reaches the open flow position shown in FIG. 20A.

Figure 21A:
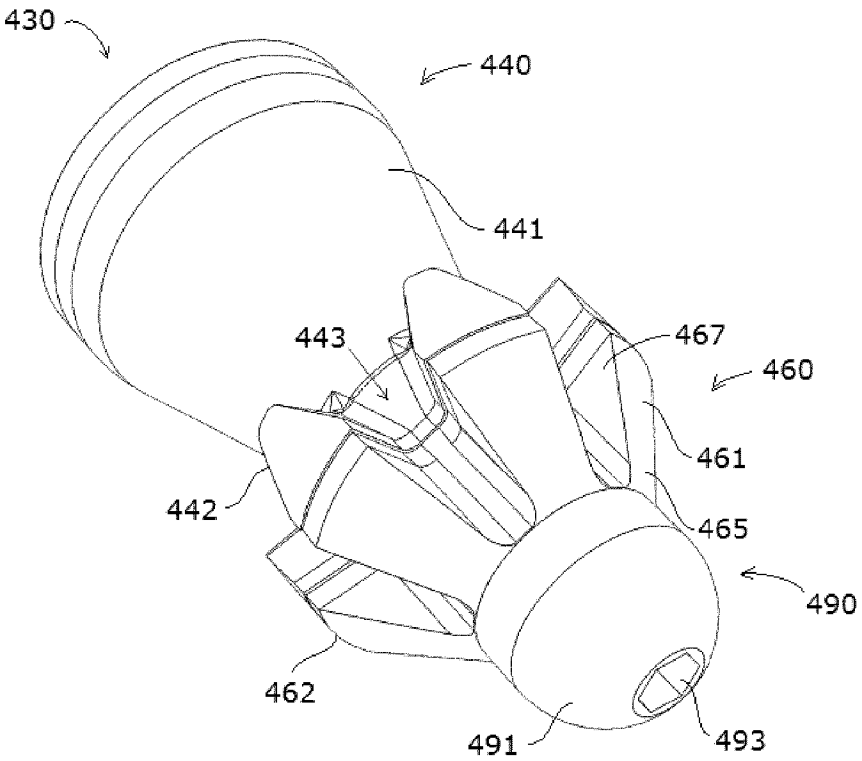
FIGS. 21A and 21B are perspective views of a fluid pressure pulse generator according to a fourth embodiment comprising a stator and a rotor, with the rotor in an open flow position (FIG. 21A) and in a restricted flow position (FIG. 21B).
Figure 21B:
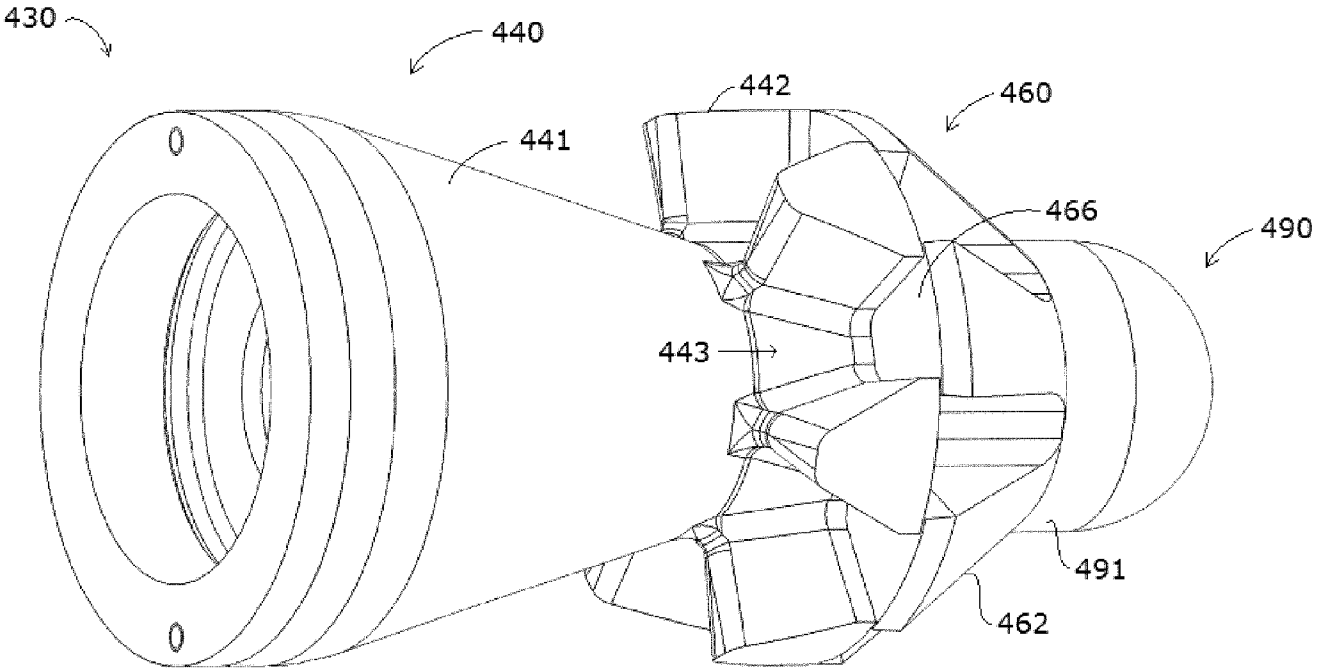

Referring to FIGS. 21A and 21B a fourth embodiment of a fluid pressure pulse generator 430 is shown comprising a stator 440 and a rotor 460. Stator 440 is similar to stator 140 of the first embodiment of the fluid pressure pulse generator 130 and comprises a longitudinally extending stator body 441 with a central bore therethrough and a plurality of radially extending projections 442 spaced equidistant around the downhole end of the stator body 441. The stator projections 442 define stator flow channels 443 therebetween.

Rotor 460 comprises a generally cylindrical rotor body (not shown) with a central bore therethrough and a plurality of radially extending wedge shaped rotor projections 462 spaced equidistant around the downhole end of the rotor body. Each rotor projection 462 has a radial profile with an uphole face 466 and a downhole end 465, with two opposed side faces 467 and an end face 461 extending between the uphole face 466 and the downhole end 465. The wedge shaped rotor projections 462 taper both along their axis and radially and are longitudinally extended compared to the rotor projections 162 and 262 of the first and second embodiments of the fluid pressure pulse generator 130, 230.

A rotor cap 490 comprising a cap body 491 and a cap shaft (not shown) releasably couples the rotor 460 to the driveshaft 24 of the MWD tool 20. The cap body 491 has a hexagonal shaped opening 493 dimensioned to receive a hexagonal Allen key which is used to torque the rotor 460 to the driveshaft 24 as described above in more detail with reference to FIGS. 2 to 7. The cap body 491 of rotor cap 490 is shorter longitudinally compared to the cap body 191, 291 of the rotor cap 190, 290 of the first and second embodiments of the fluid pressure pulse generator 130, 230 as the rotor 460 is extended longitudinally as a result of the longitudinally extending wedge shaped projections 462.

The uphole face 466 of each rotor projection 462 is wider than the stator flow channels 443, such that a portion of two adjacent stator projections 442 overlie an underlying rotor projection 462 when the rotor 460 is in the restricted flow position shown in FIG. 21B. The leading side edge 467 of each rotor projection 462 intersects the side edge 447 of one of the stator projections 442 as the rotor 460 transitions from the open flow position to the restricted flow position as described above with reference to FIG. 19. This may provide a cutting action to cut through debris or lost circulation material (LCM) that may have built up in the stator flow channels 443 to which may dislodge any debris and LCM stuck in the stator flow channels 443 and may reduce blockage of the stator flow channels 443 which could lead to restricted mud flow. The overlying rotor and stator projections 462, 442 may also reduce the requirement for such precision rotation of the rotor 460 as needed for the first and third embodiments of the fluid pressure pulse generator 130, 330 disclosed above. The degree of rotational tolerance may depend on the amount of overlap of the stator and rotor projections 442, 462.

In the fourth embodiment of the fluid pressure pulse generator 430 shown in FIGS. 21A and 21B, there are no bypass channels and mud flows through the flow bypass sleeve 170 as discussed in more detail below when the rotor 460 is in the restricted flow position shown in FIG. 21B. This may reduce erosion of the rotor and stator projections 462, 442 as mud flows through the flow bypass sleeve 170 rather than through any gaps between the stator and rotor projections 442, 462 when the rotor 460 is in the restricted flow position. The pressure increase when the fluid pressure pulse generator 430 is in the restricted flow position may be higher than the fluid pressure pulse generator 130, 230, 330 of the first, second and third embodiments, therefore the fluid pressure pulse generator 430 may be used in low mud flow rate conditions or when generation of a large pressure pulse 6 is desired.

The longitudinally extended wedge shaped rotor projections 362, 462 of the third and fourth embodiments of the fluid pressure pulse generator 330, 430 may be stronger and less fragile compared to the rotor projections 162, 262 of the first and second embodiments of the fluid pressure pulse generator 130, 230. In addition, the radial and axial taper of the wedge shaped rotor projections 362, 462 of the third and fourth embodiments of the fluid pressure pulse generator 330, 430 may reduce the amount of recirculation of mud downstream of the wedge shaped rotor projections 362, 462 which may reduce the risk of cavitations due to sudden cross-sectional area changes in mud flow. Mud flowing over the wedge shaped rotor projections 362, 462 when the rotor 360, 460 is in the restricted flow position shown in FIGS. 20B and 21B may be more streamlined than with non-wedge shaped rotor projections.

Figure 22A:
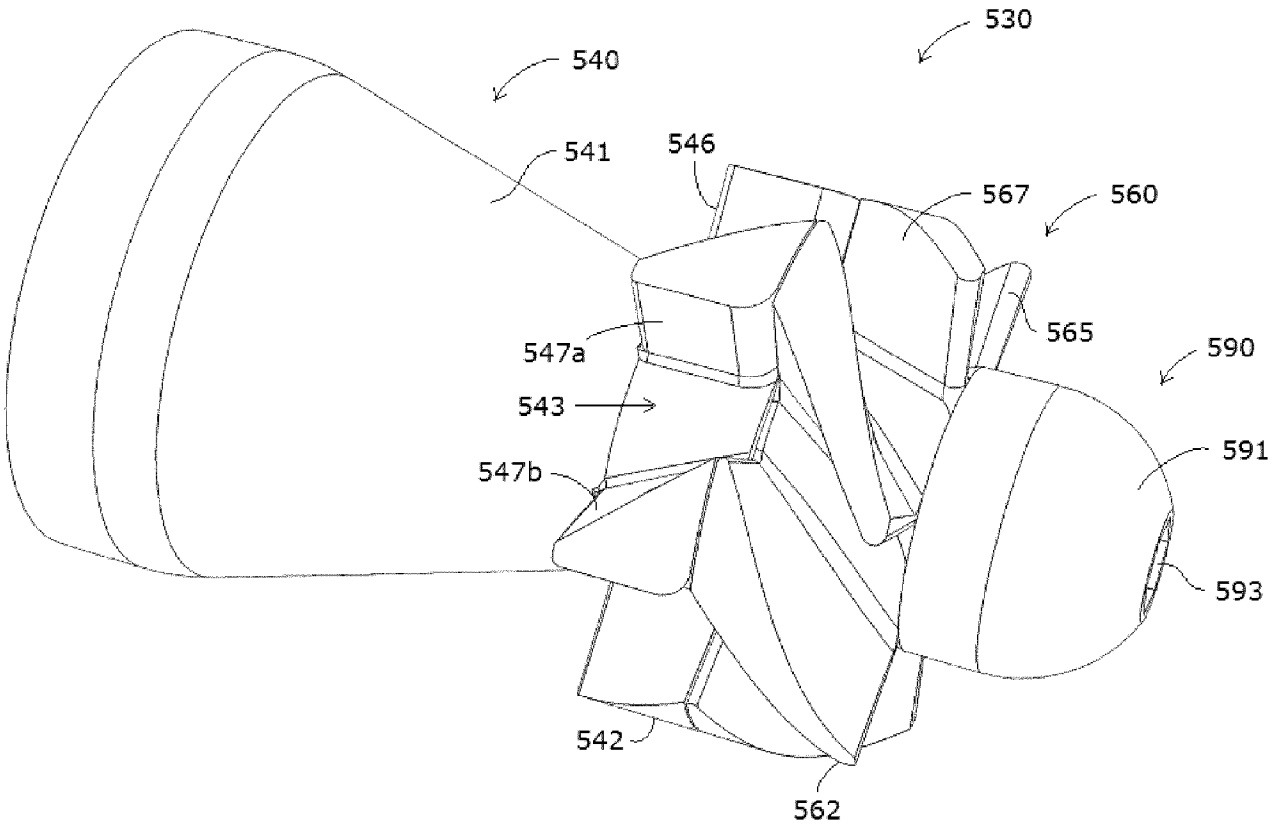
FIGS. 22A and 22B are perspective views of a fluid pressure pulse generator according to a fifth embodiment comprising a stator and a rotor, with the rotor in an open flow position (FIG. 22A) and in a restricted flow position (FIG. 22B).
Figure 22B:
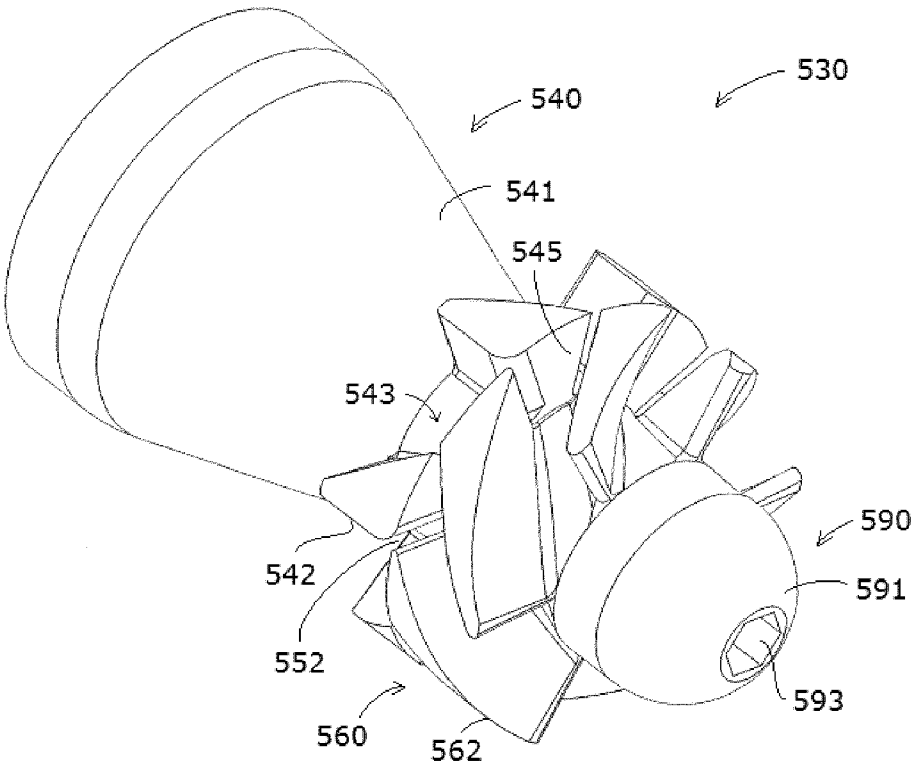

Referring to FIGS. 22A and 22B a fifth embodiment of a fluid pressure pulse generator 530 is shown comprising a stator 540 and a rotor 560. Stator 540 comprises a longitudinally extending stator body 541 with a central bore therethrough and a plurality of radially extending projections 542 spaced equidistant around the downhole end of the stator body 541. The stator projections 542 define stator flow channels 543 therebetween. The stator projections 542 have a radial profile with a rounded uphole end 546 and a downhole face 545, with two opposed side faces 547*a*, 547*b* extending therebetween. The radial profile of each stator projection 542 is tapered towards the uphole end 546 such that the uphole end 546 is narrower than the downhole face 545. One of side face 547*a* of each stator projection 542 has a face surface that is generally parallel to the direction of flow of mud through the stator flow channels 543, while the other side face 547*b* is angled relative to the direction of flow of mud through the stator flow channels 543.

Rotor 560 comprises a generally cylindrical rotor body (not shown) with a central bore therethrough and a plurality of radially extending angled rotor projections 562 spaced equidistant around the downhole end of the rotor body. The rotor projections 562 are axially adjacent and downhole of the stator projections 542. Each rotor projection 562 has a radial profile with an uphole face and a downhole end 565, with two opposed side faces 567 extending between the uphole face and the downhole end 565. The radial profile of the rotor projections 562 tapers in the downhole direction and the side faces 567 are angled relative to the direction of flow of mud through the fluid pressure pulse generator 530.

The angled side face 547*b* of the stator projections 542 directs mud flowing through the stator flow channels 543 onto one of the angled side faces 567 of the rotor projections 562 when the rotor 560 is in the open flow position shown in FIG. 22A. This causes the rotor 560 to rotate in one direction continuously when mud is flowing through the fluid pressure pulse generator 530 and the rotor projections 562 move in and out of fluid communication with the stator flow channels 543 to generate pressure pulses 6. When the rotor 560 is in the restricted flow position shown in FIG. 22B, a gap 552 between the side faces 547*a,b* of the stator projections 542 and the side faces 567 of the rotor projections 562 allows some mud to flow from the stator flow channels 543 onto the rotor side faces 567 causing the rotor 560 to rotate continuously when mud is flowing through the fluid pressure pulse generator 530.

In the embodiment shown in FIGS. 22A and 22B, the rotor 560 rotates continuously in a clockwise direction when mud is flowing through the fluid pressure pulse generator 530; however, in alternative embodiments (not shown) the stator projection side faces 547*b* and the rotor projection side faces 567 may be angled in the opposite direction resulting in counter-clockwise rotation of the rotor 560. In alternative embodiments (not shown), both or neither of the side faces 547*a,b* of the stator projections 542 may be angled relative to the direction of flow of mud and/or only one of the side faces 567 of the rotor projections 562 may be angled relative to the direction of flow of mud.

A rotor cap 590 comprising a cap body 591 and a cap shaft (not shown) releasably couples the rotor 560 to the driveshaft 24 of the MWD tool 20. The cap body 591 has a hexagonal shaped opening 593 dimensioned to receive a hexagonal Allen key which is used to torque the rotor 560 to the driveshaft 24 as described above in more detail with reference to FIGS. 2 to 7.

Figure 23A:
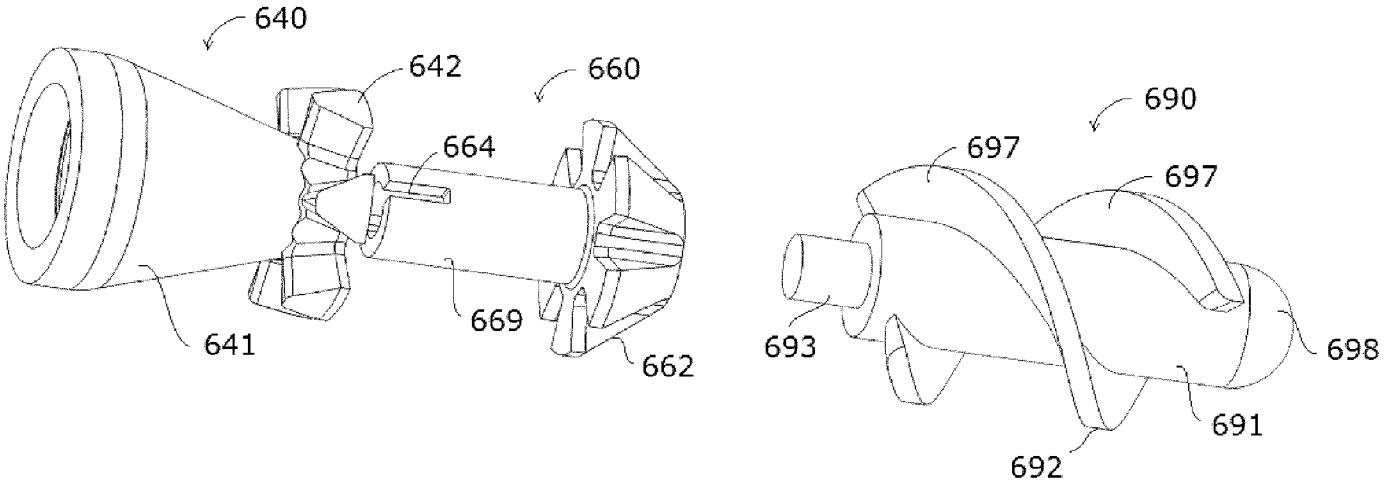
FIG. 23A is an exploded perspective view of a fluid pressure pulse generator of a sixth embodiment comprising a stator, a rotor and an angled blade array.
Figure 23B:
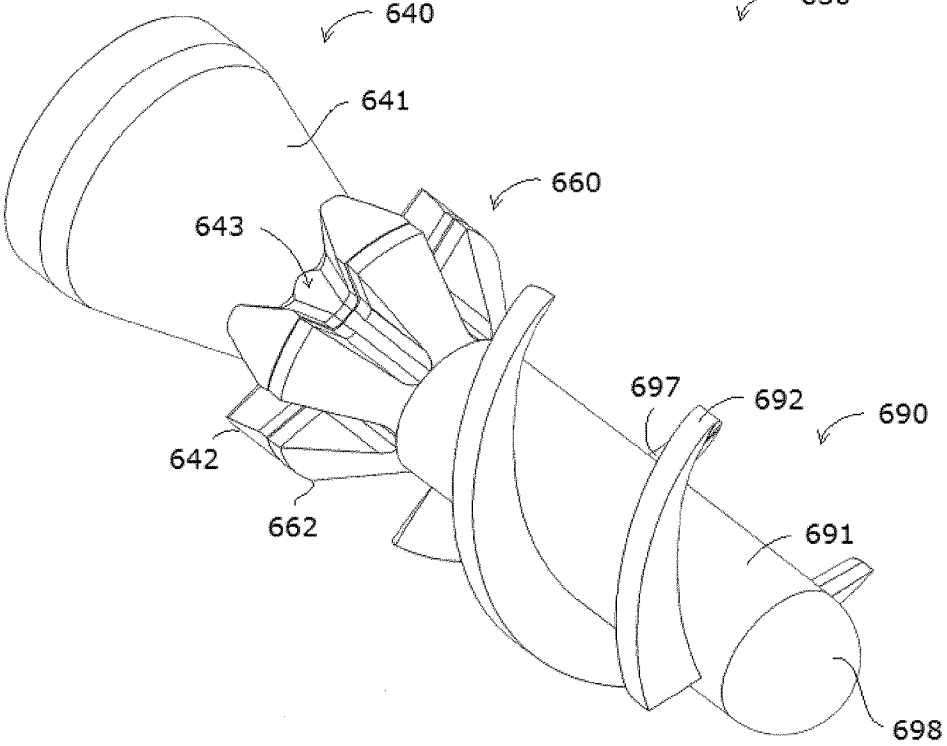
FIG. 23B is a perspective view of the assembled fluid pressure pulse generator of FIG. 23A with the rotor in an open flow position.

Referring to FIGS. 23A and 23B a sixth embodiment of a fluid pressure pulse generator 630 is shown comprising a stator 640, a rotor 660 and an angled blade array 690. Stator 640 is similar to stator 440 of the fourth embodiment of the fluid pressure pulse generator 430 and comprises a longitudinally extending stator body 641 with a central bore therethrough and a plurality of radially extending projections 642 spaced equidistant around the downhole end of the stator body 641. The stator projections 642 define stator flow channels 643 therebetween.

Rotor 660 is similar to rotor 460 of the fourth embodiment of the fluid pressure pulse generator 430 and comprises a generally cylindrical rotor body 669 with a central bore therethrough and a plurality of radially extending wedge shaped rotor projections 662 spaced equidistant around the downhole end of the rotor body 669. The rotor projections 662 are axially adjacent and downhole of the stator projections 642. The wedge shaped rotor projections 662 taper both along their axis and radially and are longitudinally extended compared to the rotor projections 162, 262 of the first and second embodiments of the fluid pressure pulse generator 130, 230. The rotor body 669 is coupled to the driveshaft 24 of the MWD tool 20 via a coupling key (not shown) received in coupling key receptacle 664 at the uphole end of the rotor body 669 as described in more detail above with reference to FIG. 2A.

Angled blade array 690 is positioned at the downhole end of the rotor 660 and comprises a longitudinally extending body 691 and a pair of fins 692 helically wrapped around the body 691 such that a side face 697 of each of the fins 692 is angled relative to the direction of mud flow through the pressure pulse generator 630. A shaft 693 extends from the uphole end of the body 691 and is received in the downhole end of the bore of the rotor body 669 to couple the angled blade array 690 to the rotor 660. Body 691 has a rounded downhole end 698 for smooth flow of mud downhole of the fins 697. Mud flowing through the fluid pressure pulse generator 630 hits side face 697 of the fins 692 causing the angled blade array 690 to rotate continuously in the one direction when mud is flowing through the fluid pressure pulse generator 630. As the angled blade array 690 is coupled to the rotor 660, rotation of the angled blade array 660 results in rotor projections 662 moving in and out of fluid communication with the stator flow channels 643 generating pressure pulses 6. In the embodiment shown in FIGS. 23A and 23B, the angled blade array 690 rotates in a clockwise direction when mud is flowing through the fluid pressure pulse generator 630; however, in alternative embodiments (not shown) the fins 692 may be helically wrapped in the opposite direction resulting in counter-clockwise rotation of the angled blade array 690 and thus the rotor 660.

Figure 24:
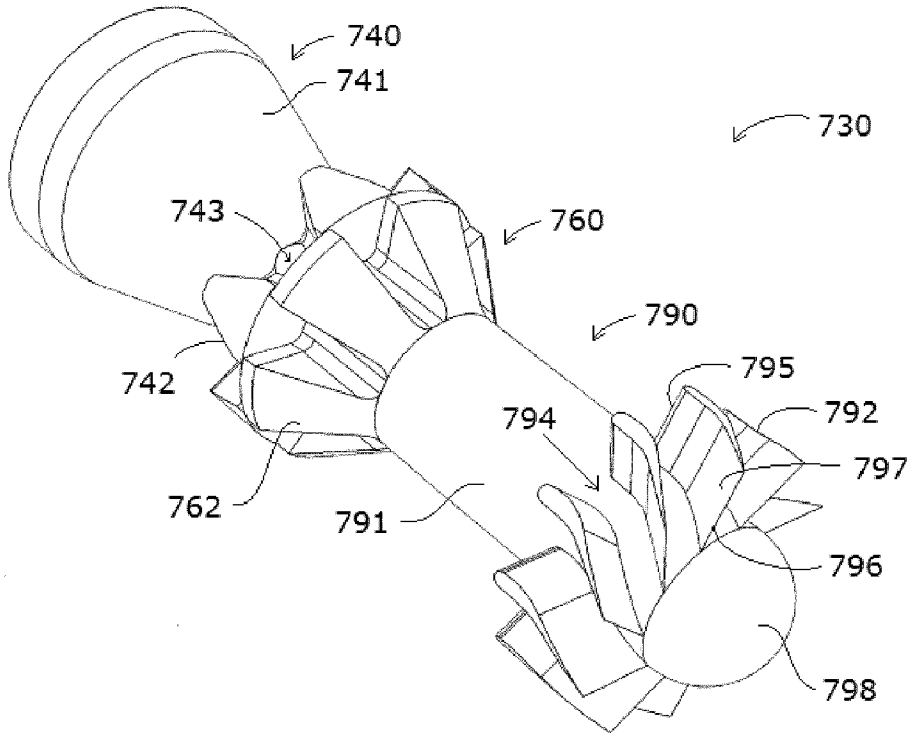
FIG. 24 is a perspective view of a fluid pressure pulse generator of a seventh embodiment comprising a stator, a rotor and an angled blade array with the rotor in a restricted flow position.

Referring to FIG. 24 a seventh embodiment of a fluid pressure pulse generator 730 is shown comprising a stator 740, a rotor 760 and an angled blade array 790. Stator 740 is similar to stator 640 of the sixth embodiment of the fluid pressure pulse generator 630 and comprises a longitudinally extending stator body 741 with a central bore therethrough and a plurality of radially extending projections 742 spaced equidistant around the downhole end of the stator body 741. The stator projections 742 define stator flow channels 743 therebetween. Rotor 760 is similar to rotor 660 of the sixth embodiment of the fluid pressure pulse generator 630 and comprises a generally cylindrical rotor body (not shown) with a central bore therethrough and a plurality of radially extending wedge shaped rotor projections 762 spaced equidistant around the downhole end of the rotor body. The rotor projections 762 are axially adjacent and downhole of the stator projections 742.

Angled blade array 790 is positioned at the downhole end of the rotor 760 and is coupled to the rotor through a shaft (not shown) received in the bore of the rotor body (not shown) as described above with reference to FIG. 23A. Angled blade array 790 comprises a longitudinally extending body 791 and a plurality of blades 792 equally spaced around the downhole end of the body 791. Body 791 has a rounded downhole end 798 for smooth flow of mud downhole of the blades 792. The blades 792 have a radial profile with a rounded uphole end 795 and a downhole end 796 with two opposed side faces 797 extending therebetween. The radial profile of the blades 792 tapers in the downhole direction such that the downhole end 796 is narrower than the uphole end 795. The side faces 797 are curved (angled) relative to the direction of flow of mud through the fluid pressure pulse generator 730, such that mud flowing through flow channels 794 defined by adjacent blades 792 hits the curved side face 797 causing the angled blade array 790 to rotate continuously in the one direction when mud is flowing through the fluid pressure pulse generator 730. As the angled blade array 790 is coupled to the rotor 760, rotation of the angled blade array 790 results in the rotor projections 762 moving in and out of fluid communication with the stator flow channels 743 generating pressure pulses 6. In the embodiment shown in FIG. 24, the angled blade array 790 rotates in a clockwise direction when mud is flowing through the fluid pressure pulse generator 730; however, in alternative embodiments (not shown) the side faces 797 of the blades 792 may be angled in the opposite direction resulting in counter-clockwise rotation of the angled blade array 790 and thus the rotor 760. In an alternative embodiment (not shown), the blades 792 may be adjustable to adjust the angle at which mud impinges against the side faces 797 of the blades 792 to control the speed of rotation of the angled blade array 790.

The angled rotor projections 562 of fluid pressure pulse generator 530 and the angled blade array 690, 790 of fluid pressure pulse generator 630, 730 respectively cause rotor 560, 660, 760 to rotate when mud flows through the fluid pressure pulse generator 530, 630, 730 thereby conserving battery power. Rotation of the rotor 560, 660, 760 as a result of mud flowing through the fluid pressure pulse generator 530, 630, 730 may also generate power for the MWD tool 20. As the rotor 560, 660, 760 is coupled to the driveshaft 24 and the driveshaft 24 is coupled to the motor and gearbox subassembly 23 of the MWD tool 20, any power generated through rotation of the rotor 560, 660, 760 may be stored in a capacitor bank or battery or diverted to another power draining component within the MWD tool 20. A controller (not shown) in the electronics subassembly 28 of the MWD tool 20 may control rotational timing of rotor 560, 660, 760 so that the pressure pulses 6 transmitted to the surface represent the carrier wave and can be decoded to provide an indication of downhole conditions while drilling. Rotational timing of the rotor 560, 660, 760 may be controlled by any means known in the art, for example, by changing the motor speed or braking.

In alternative embodiments (not shown) angled blade array 690, 790 may be positioned at the downhole end of rotor 160, 260, 360, 460, 560 to replace the rotor cap 190, 290, 390, 490, 590 of fluid pressure pulse generator 130, 230, 330, 430, 530 described above. In alternative embodiments the angled blade array 690, 790 may comprise any size or shape angled blade which extends into the flow path of mud flowing through the fluid pressure pulse generator and is not restricted to the fins 692 or blades 792 disclosed herein.

In the first to third embodiments of the fluid pressure pulse generator 130, 230, 330 disclosed herein, the uphole portion of each side face 167, 267, 367 of the rotor projections 162, 262, 362 includes bevelled edge 168, 268, 368. The angle of the bevelled edges 168, 268, 368 may be any angle up to 90 degrees but is typically between about 5 to 45 degrees. The angle of the bevelled edge 168, 268, 368 of one side face 167, 267, 367 may be different to the angle of the bevelled edge 168, 268, 368 of the opposed side face 167, 267, 367 of each rotor projection 162, 262, 362 or only one of the opposed side faces 167, 267, 367 may include a bevelled edge 168, 268, 368. The proportion of each side face 167, 267, 367 that is angled or bevelled may also vary and in alternative embodiments (not shown) the whole of side face 167, 267, 367 may be angled. In further alternative embodiments, none, or not all of the rotor projections 162, 262, 362 may have a bevelled edge 168, 268, 368 and some side faces 167, 267, 367 may instead be perpendicular to or angled away from the uphole face or end 166, 266. The rotor projections 462, 562, 662, 762 of the fourth to seventh embodiments of the fluid pressure pulse generator 430, 530, 630, 730 disclosed herein may also have a radial profile which tapers towards its uphole end or face.

Referring now to FIGS. 8A, 9, 10 and 13 there is shown the flow bypass sleeve 170 of the first embodiment comprising a generally cylindrical sleeve body with a central bore therethrough made up of an uphole body portion 171*a* and a downhole body portion 171*b*. Referring to FIGS. 8B, 11, 12 and 14 a second embodiment of a flow bypass sleeve 270 is shown comprising a generally cylindrical sleeve body with a central bore therethrough made up of an uphole body portion 271*a* and a downhole body portion 271*b*.

During assembly of the first and second embodiments of the flow bypass sleeve 170, 270 a lock down sleeve 81 is slid over the downhole end of uphole body portion 171*a*, 271*a* and abuts an annular shoulder 183, 283 on the external surface of uphole body portion 171*a*, 271*a* respectively. An uphole end of downhole body portion 171*b*, 271*b* is received in the downhole end of the lock down sleeve 81. The assembled flow bypass sleeve 170, 270 can then be inserted into the downhole end of drill collar 27. The external surface of uphole body portion 171*a*, 271*a* includes an annular shoulder 180, 280 near the uphole end of uphole body portion 171*a*, 271*a* respectively which abuts a downhole shoulder of a keying ring (not shown) that is press fitted into the drill collar 27. A keying notch 184, 284 on the external surface of uphole body portion 171*a*, 271*a* respectively mates with a projection (not shown) on the keying ring to correctly align the flow bypass sleeve 170, 270 with the pulser assembly 26. A threaded ring (not shown) fixes the flow bypass sleeve 170, 270 within the drill collar 27. A groove 185, 285 on the external surface of the uphole body portion 171*a*, 271*a* respectively receives an o-ring (not shown) and a rubber back-up ring (not shown) such as a parbak to help seat the flow bypass sleeve 170, 270 and reduce fluid leakage between the flow bypass sleeve 170, 270 and the drill collar 27. In alternative embodiments the flow bypass sleeve 170, 270 may be assembled or fitted within the drill collar 27 using alternative fittings as would be known to a person of skill in the art.

The lock down sleeve 81 may be made from a material with a higher thermal expansion coefficient than the material of the sleeve body. For example, the lock down sleeve 81 may comprise beryllium copper and the sleeve body may comprise Stellite. Providing different thermal expansion coefficients materials that make up the external surface of the flow bypass sleeve 170, 270 may help clamp the flow bypass sleeve 170, 270 within the drill collar 27 across a wider range of temperatures than a flow bypass sleeve comprising the same material throughout.

As shown in FIG. 2A, the diameter of the bore through the sleeve body is smallest at a central section 177 which surrounds the stator projections 142 and rotor projections 162. The outer diameter of the stator projections 142 may be dimensioned such that the stator projections 142 contact the internal surface of the central section 177 of the sleeve body. The outer diameter of the rotor projections 162 is slightly less than the internal diameter of the central section 177 of the sleeve body to allow rotation of the rotor projections 162 relative to the sleeve body. The bore through the sleeve body gradually increases in diameter from the central section 177 towards the downhole end of the sleeve body to define an internally tapered downhole section 176. The bore through the sleeve body also increases in diameter from the central section 177 towards the uphole end of the sleeve body to define an internally tapered uphole section 179 of sleeve body. The taper of the uphole section 179 is greater than the taper of downhole section 176 of sleeve body. The uphole section 179 of sleeve body surrounds the frusto-conical section of stator body 141 with the annular channel 56 extending therebetween. Mud flows along annular channel 56 and hits the stator projections 142 where it is channelled into the stator flow channels 143. The downhole section 176 of the sleeve body surrounds the rotor cap body 191.

In the first embodiment of the flow bypass sleeve 170, the internal surface of the uphole body portion 171*a* includes a plurality of longitudinal extending grooves 173. Grooves 173 are equidistantly spaced around the internal surface of the uphole body portion 171*a*. Internal walls 174 in-between each groove 173 align with the stator projections 142 of the fluid pressure pulse generator 130, and the grooves 173 align with the stator flow channels 143. The flow bypass sleeve 170 is precisely located with respect to the drill collar 27 using keying notch 184 to ensure correct alignment of the stator projections 142 with the internal walls 174. The rotor projections 162 rotate relative to the flow bypass sleeve 170 and move between the open flow position (shown in FIG. 13) where the rotor projections 162 align with the internal walls 174 and the restricted flow position (not shown) where the rotor projections 162 align with the grooves 173.

Figure 14:
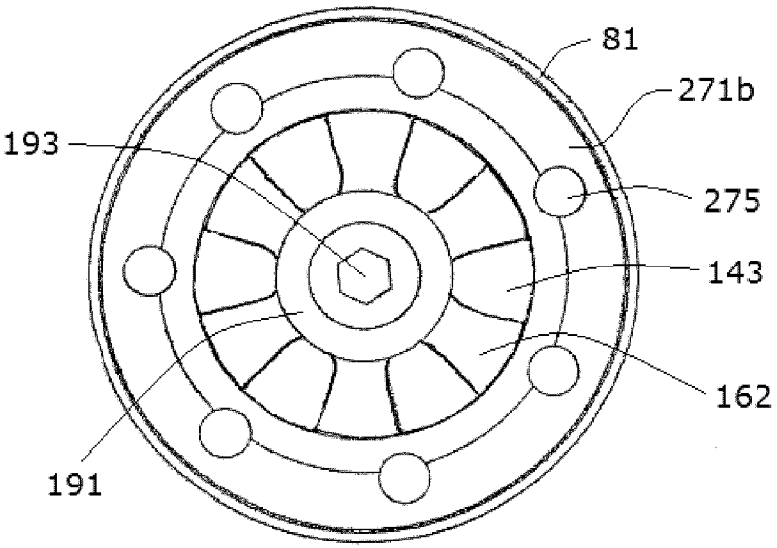
FIG. 14 is a downhole end view of the flow bypass sleeve of the second embodiment surrounding the fluid pressure pulse generator of the first embodiment with the rotor in the open flow position.
Figure 13:
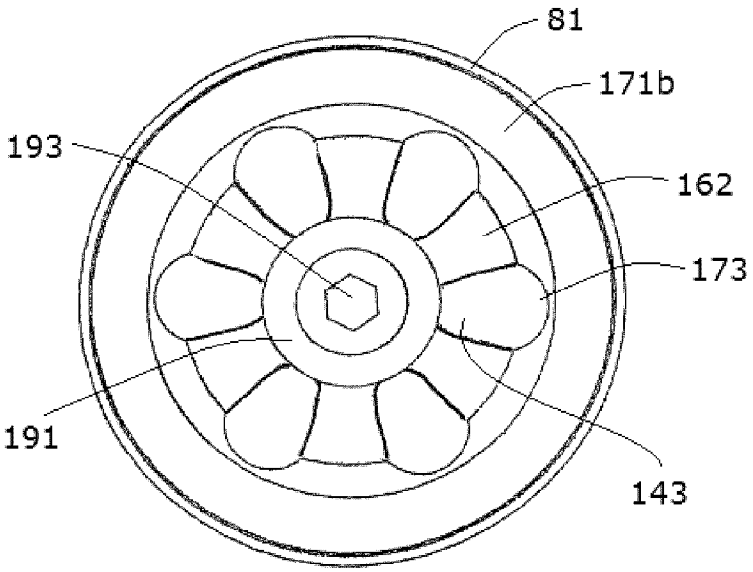
FIG. 13 is a downhole end view of the flow bypass sleeve of the first embodiment surrounding the fluid pressure pulse generator of the first embodiment with the rotor in the open flow position.

In the second embodiment of the flow bypass sleeve 270 a plurality of apertures 275 extend longitudinally through the uphole body portion 271*a*. The apertures 275 are circular and equidistantly spaced around uphole body portion 271*a*. The internal surface of the downhole body portion 271*b* includes a plurality of spaced grooves 278 which align with the apertures 275 in the assembled flow bypass sleeve 270 (shown in FIG. 12), such that mud is channelled through the apertures 275 and into grooves 278. Alignment pins 282 on the uphole surface of the downhole body portion 271*b* align with recesses (not shown) on the downhole surface of the uphole body portion 271*a* to correctly align the apertures 275 with the grooves 278. The internal surface of uphole body portion 271*a* which surrounds the rotor and stator projections 162, 142 is uniform in this embodiment (as shown in FIG. 14); therefore there is no need to align the stator projections 142 with any internal feature of the uphole body portion 271*a* as with the first embodiment of the flow bypass sleeve 170 described above. The sleeve body generally needs to be wide enough to support the apertures 275 and the drill collar dimensions may be a limiting factor with respect to use of the second embodiment of the flow bypass sleeve 270. As such, the second embodiment of the flow bypass sleeve 270 may be used with larger drill collars 27, for example drill collars that are 8 inches or more in diameter. In alternative embodiments (not shown) the apertures 275 may be any shape and need not be equidistantly spaced around the sleeve body. The number and size of the apertures 275 may be chosen for the desired amount of mud flow therethrough. In further alternative embodiments (not shown) the grooves 278 may have a different shape or may not be present at all.

Figure 17:
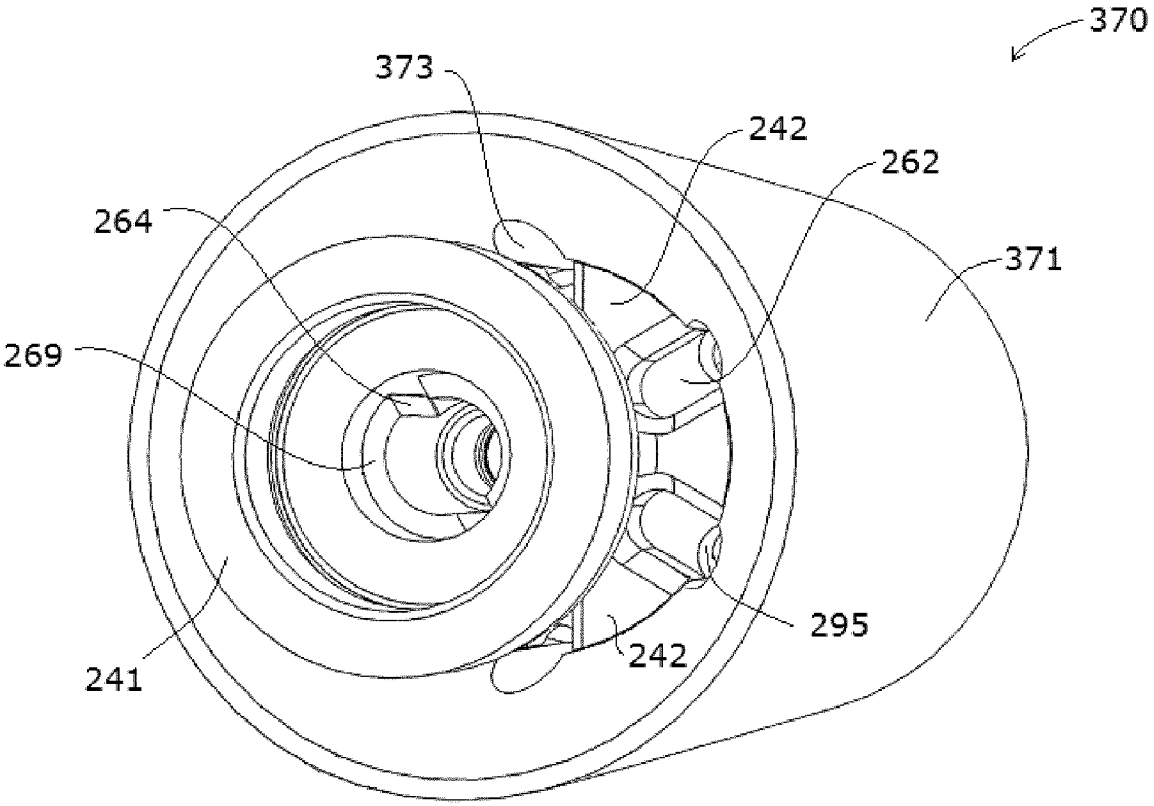
FIG. 17 is a perspective view of the uphole end of a flow bypass sleeve according to a third embodiment surrounding the fluid pressure pulse generator of the second embodiment with the rotor in the restricted flow position.
Figure 18:
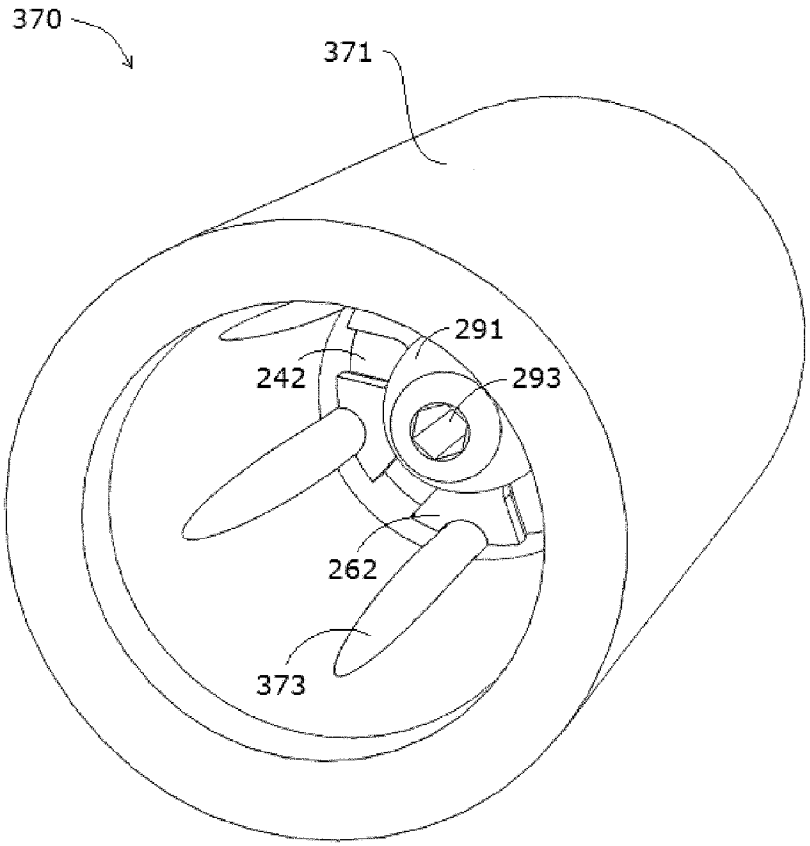
FIG. 18 is a perspective view of the downhole end of the flow bypass sleeve of the third embodiment and the fluid pressure pulse generator of the second embodiment with the rotor in the restricted flow position.
Figure 19A:
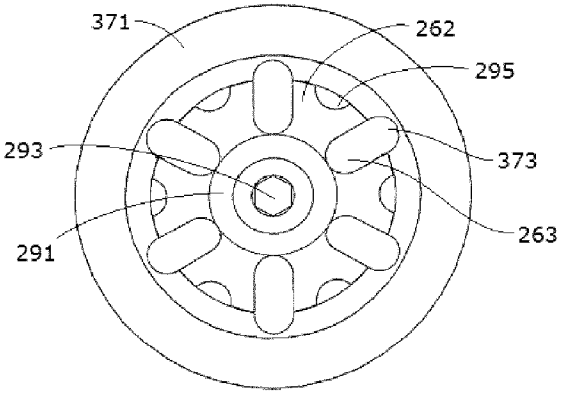
FIGS. 19A, 19B and 19C are downhole end views of the flow bypass sleeve of the third embodiment and the fluid pressure pulse generator of the second embodiment with the rotor in the open flow position (FIG. 19A), the restricted flow position (FIG. 19B) and transitioning between the open and restricted flow positions (FIG. 19C).
Figure 19C:
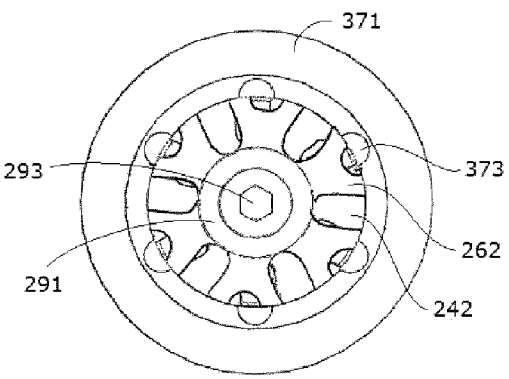
Figure 19B:
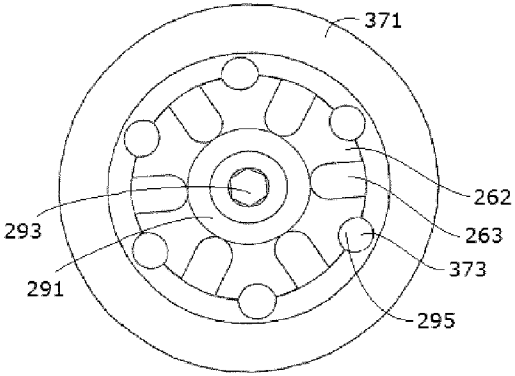

Referring to FIGS. 17 to 19 a third embodiment of a flow bypass sleeve 370 is shown comprising a generally cylindrical sleeve body 371 with a central bore therethrough. The flow bypass sleeve 370 is shown surrounding the second embodiment of the fluid pressure pulse generator 230. The sleeve body 371 includes a plurality of longitudinal extending grooves 373 equidistantly spaced around the internal surface of the sleeve body 371. The grooves 373 are semi-circular and dimensioned to correspond in width to the width of both the semi-circular grooves of the bypass channels 295 in the rotor projections 262 and the rotor flow channels 263 of the fluid pressure pulse generator 230 of the second embodiment. When the rotor 260 is in the restricted flow position shown in FIGS. 17, 18 and 19B, the grooves 373 and the bypass channels 295 align to form circular bypass channels for flow of mud therethrough. When the rotor 260 is in the open flow position shown in FIG. 19A, the grooves 373 and the rotor flow channels 263 align to form larger oval flow channels. As the rotor 260 rotates between the open flow and restricted flow positions, less mud can flow through the smaller circular bypass channels in the restricted flow position than through the oval flow channels in the open flow position, thereby generating pressure pulses 6. In alternative embodiments (not shown) the grooves 373 may be any shape and dimensioned for the desired amount of mud flow therethrough.

In an alternative embodiment of the flow bypass sleeve (not shown), the sleeve body may include both internal grooves and longitudinally extending apertures for flow of mud therethrough.

The external dimensions of flow bypass sleeve 170, 270, 370 may be adapted to fit any sized drill collar 27. It is therefore possible to use a one size fits all fluid pressure pulse generator with multiple sized flow bypass sleeves 170, 270, 370 with various different external circumferences that are dimensioned to fit different sized drill collars 27. Each of the multiple sized flow bypass sleeves 170, 270, 370 may have the same internal dimensions to receive the one size fits all fluid pressure pulse generator but different external dimensions to fit the different sized drill collars 27.

The flow bypass sleeve 170, 270, 370 may be used with any of the first to seventh embodiments of the fluid pressure pulse generators 130, 230, 330, 430, 530, 630, 730 described herein. In alternative embodiments (not shown), the first, second, third and fifth embodiments of the fluid pressure pulse generator 130, 230, 330, 530 described herein may be present in the drill collar 27 without the flow bypass sleeve 170, 270, 370. In these alternative embodiments, the stator projections 142, 242, 342, 542 and rotor projections 162, 262, 362, 562 may have an external diameter that is greater than the external diameter of the cylindrical section of the stator body 141, 241, 341, 541, such that mud following along annular channel 55 impinges on the stator projections 142, 242, 342, 542 and is directed through the stator flow channels 143, 243, 343, 543. The stator projections 142, 242, 342, 542 and rotor projections 162, 262, 362, 562 may radially extend to meet the internal surface of the drill collar 27. There is a small gap between the external surface of the rotor projections 162, 262, 362, 562 and the internal surface of the drill collar 27 to allow rotation of the rotor projections 162, 262, 362, 562 relative to the drill collar 27. The fourth, sixth and seventh embodiments of the fluid pressure pulse generator 430, 630, 730 may also be used without the flow bypass sleeve 170, 270, 370; however, it may be necessary to have a gap between the rotor and stator projections 442, 462, 642, 662, 742, 762 and the internal surface of the drill collar 27 to allow some flow of mud through the pressure pulse generator when the rotor 460, 660, 760 is in the restricted flow position to prevent pressure build up. The innovative aspects apply equally in embodiments such as these.

In the fourth, sixth and seventh embodiments of the fluid pressure pulse generator 430, 630, 730, the flow bypass sleeve 170, 270, 370 may be used to provide a bypass flow of mud through the fluid pressure pulse generator 430, 630, 730 when the rotor 460, 660, 760 is in the restricted flow position to prevent pressure build up.

When the flow bypass sleeve 170, 270, 370 is used to surround the fluid pressure pulse generator 630, 730 including the angled blade array 690, 790 at the downhole end thereof, mud may flow through the flow bypass sleeve 170, 270, 370 and hit the fins 692 or blades 792 to cause rotation of the angled blade array 690, 790 and rotor 660, 760 respectively coupled thereto as the fins 692 and blades 792 may be downstream of the mud outlet of the internal grooves 173, 373 of flow bypass sleeve 170, 370 and the longitudinally extending apertures 275 of flow bypass sleeve 270.

While particular embodiments have been described in the foregoing, it is to be understood that other embodiments are possible and are intended to be included herein. It will be clear to any person skilled in the art that modification of and adjustments to the foregoing embodiments, not shown, are possible.

The invention claimed is:

1. A downhole telemetry tool comprising:

a pulser assembly comprising a housing enclosing a driveshaft; and a fluid pressure pulse generator apparatus comprising:

(a) a stator comprising a stator body with a bore therethrough and a plurality of radially extending stator projections spaced around an external surface of the stator body, whereby adjacently spaced stator projections define stator flow channels extending therebetween; and (b) a rotor comprising a rotor body and a plurality of radially extending rotor projections spaced around an external surface of the rotor body, wherein an end of the stator body is fixedly attached to a downhole end of the housing and the rotor is fixedly attached to the driveshaft with the driveshaft and/or the rotor body received within the bore of the stator body such that the stator projections are positioned between the pulser assembly and the rotor projections and the rotor projections are positioned downhole relative to the stator projections, wherein the rotor projections are axially adjacent to the stator projections and rotate relative to the stator projections such that the rotor projections move in and out of fluid communication with the stator flow channels to create fluid pressure pulses in fluid flowing through the stator flow channels.

2. The downhole telemetry tool of claim 1, wherein the rotor projections have a radial profile with an uphole end, a downhole end and two opposed side faces extending therebetween, and a section of the radial profile of at least one of the rotor projections is tapered towards the uphole end, whereby if rotation is stopped when the tapered section of the at least one rotor projection is in fluid communication with the stator flow channels, the fluid flowing through the stator flow channels impinges on the tapered section and moves the rotor until the tapered section of the at least one rotor projection is out of fluid communication with the stator flow channels.

3. The downhole telemetry tool of claim 2, wherein at least one of the side faces of the tapered rotor projection has a bevelled uphole edge.

4. The downhole telemetry tool of claim 1, wherein at least one of the rotor projections tapers radially in the downhole direction.

5. The downhole telemetry tool of claim 1, wherein at least a portion of the rotor body is received within the bore of the stator body and the rotor body has a bore therethrough which receives a portion of the driveshaft.

6. The downhole telemetry tool of claim 5, further comprises a rotor cap comprising a cap body and a cap shaft, the cap shaft being received in the bore of the rotor body to releasably couple the rotor cap to the driveshaft.

7. The downhole telemetry tool of claim 1, wherein at least one of the rotor projections includes a bypass channel with an axial channel inlet and an axial channel outlet for flow of the fluid therethrough when the rotor projections are in fluid communication with the stator flow channels.

8. The downhole telemetry tool of claim 1, wherein the rotor projections are wider than the stator flow channels.

9. The downhole telemetry tool of claim 1, wherein the stator projections have a radial profile with an uphole end, a downhole end and two opposed side faces extending therebetween.

10. The downhole telemetry tool of claim 9, wherein the uphole end of at least one of the stator projections is rounded.

11. The downhole telemetry tool of claim 9, wherein a section of the radial profile of at least one of the stator projections is tapered towards the uphole end.

12. The downhole telemetry tool of claim 1, wherein at least one of the rotor projections is angled relative to a flow path of the fluid flowing through the stator flow channels, such that the fluid flowing through the stator flow channels hits the at least one angled rotor projection causing the rotor to rotate relative to the stator.

13. The downhole telemetry tool of claim 12, wherein the stator projections have a radial profile with an uphole end, a downhole end and two opposed side faces extending therebetween, wherein at least one of the side faces is angled relative to the flow path of the fluid flowing through the stator flow channels.

14. The downhole telemetry tool of claim 1 further comprising an angled blade array coupled to the rotor body, the angled blade array comprising one or more than one angled blade positioned downhole of the rotor projections and extending into a flow path of fluid flowing through the fluid pressure pulse generator, wherein the angled blade is angled relative to the flow path of fluid flowing through the fluid pressure pulse generator such that the fluid flowing through the fluid pressure pulse generator hits the angled blade causing rotation of the rotor relative to the stator.

15. The downhole telemetry tool of claim 14, wherein the angled blade array comprises a blade array body coupled to the rotor body and the angled blade comprises a fin helically wrapped around the blade array body.

16. The downhole telemetry tool of claim 14, wherein the angled blade array comprises a blade array body coupled to the rotor body and a plurality of angled blades spaced around the blade array body.

17. The downhole telemetry tool of claim 1, wherein the pulser assembly further comprises a motor coupled with the driveshaft and enclosed by the housing, wherein the motor rotates the driveshaft and rotor relative to the stator such that the rotor projections move in and out of fluid communication with the stator flow channels to create the fluid pressure pulses.

* * * * *